US005455378A

United States Patent [19]

Paulson et al.

[11] Patent Number: 5,455,378

[45] Date of Patent: Oct. 3, 1995

[54] INTELLIGENT ACCOMPANIMENT APPARATUS AND METHOD

[75] Inventors: John W. Paulson, Edina; Mark E. Dunn, Apple Valley; Allen J. Heidorn, Minnetonka, all of Minn.

[73] Assignee: Coda Music Technologies, Inc., Eden Prairie, Minn.

[21] Appl. No.: 261,161

[22] Filed: Jun. 17, 1994

Related U.S. Application Data

[63] Continuation-in-part of Ser. No. 65,831, May 21, 1993.

[51] Int. Cl.[6] ..... G10H 1/36

[52] U.S. Cl. ..... 84/610; 84/634; 84/666

[58] Field of Search ..... 84/601, 602, 604, 84/607, 609–610, 634, 635, 649–650, 666–667, 712

[56] References Cited

U.S. PATENT DOCUMENTS

| | | |
|---|---|---|
| 4,471,163 | 9/1984 | Donald et al. . |
| 4,562,306 | 12/1985 | Chou et al. . |
| 4,593,353 | 6/1986 | Pickholtz . |
| 4,602,544 | 7/1986 | Yamada et al. . |
| 4,621,321 | 11/1986 | Boebert et al. . |
| 4,630,518 | 12/1986 | Usam . |
| 4,651,612 | 3/1987 | Matsumoto . |
| 4,685,055 | 8/1987 | Thomas . |
| 4,688,169 | 8/1987 | Joshi . |
| 4,740,890 | 4/1988 | William . |
| 4,745,836 | 5/1988 | Dannenberg . |
| 5,034,980 | 7/1991 | Kubota . |
| 5,056,009 | 10/1991 | Mizuta . |
| 5,113,518 | 5/1992 | Durst, Jr. et al. . |
| 5,131,091 | 7/1992 | Mizuta . |

OTHER PUBLICATIONS

P. Allen et al., "Tracking Musical Beats in Real Time," *ICMC Glascow 1990 Proceedings,* (1990), pp. 140–143.

J. Bloch et al., "Real–Time Computer Accompaniment of Keyboard Performances," *Proceedings Of International Computer Music Conference,* (1985), pp. 279–290.

W. Buxton et al., "The Computer as Accompanist," *CHI '86 Proceedings,* (Apr. 1986), pp. 41–43.

P. Capell et al., "Instructional Design and Intelligent Tutoring: Theory and the Precision of Design," *Jl. of Artificial Intelligence in Education,* (1993) 4(1), pp. 95–121.

R. Dannenberg, "Music Representation Issues, Techniques, and Systems," *Computer Music Journal,* 17:3 (Fall 1993), pp. 20–30.

R. Dannenberg et al., "Results from the Piano Tutor Project," *The Fourth Biennial Arts & Technology Symposium,* Connecticut College (Mar. 1993), pp. 143–149.

R. Dannenberg, "Software Support for Interactive Multimedia Performance," *Interface,* vol. 22 (1993), pp. 213–228.

R. Dannenberg et al., "Human–Computer Interaction in the Piano Tutor," Multimedia Interface Design, (1992), pp. 65–78.

R. Dannenberg et al., "Practical Aspects of a Midi Conducting Program," *Proceedings of International Computer Music Conference,* (1991), pp. 537–540.

(List continued on next page.)

*Primary Examiner*—Vit W. Miska

*Attorney, Agent, or Firm*—Merchant, Gould, Smith, Edell, Welter & Schmidt

[57] ABSTRACT

A system for interpreting the requests and performance of an instrumental soloist, stated in the parlance of the musician and within the context of a specific published edition of music the soloist is using, to control the performance of a digitized musical accompaniment. Sound events and their associated attributes are extracted from the soloist performance and are numerically encoded. The pitch, duration and event type of the encoded sound events are then compared to a desired sequence of the performance score to determine if a match exists between the soloist performance and the performance score. If a match exists between the soloist performance and the performance score, the system instructs a music synthesizer module to provide an audible accompaniment for the soloist. The system provides a method for marking a music sequence data segment to match a musical performance score using a musical instrument digital interface (MIDI) marker message.

17 Claims, 25 Drawing Sheets

OTHER PUBLICATIONS

R. Dannenberg, "Software Support for Interactive Multimedia Performance," *Proceedings The Arts and Technology 3,* The Center for Art and Technology at Connecticut College, (1991), pp. 148–156.

R. Dannenberg, *Real–Time Computer Accompaniment,* Copyright 1990 Roger B. Dannenberg, Handout at Accoustical Society of America May 1990, pp. 1–10.

R. Dannenberg et al., "An Expert System for Teaching Piano to Novices," *ICMC Glasgow Proceedings,* (1990), pp. 20–23.

R. Dannenberg, "Recent work in real–time music understanding by computer," *Music, Language, Speech and Brain,* Wenner–Gren International Symposium Series, vol. 59, (1990), pp. 194–202.

R. Dannenberg, "Real Time Control For Interactive Computer Music and Animation," *The Arts & Technology II: A Symposium,* Connecticut College, (1989), pp. 85–95.

R. Dannenberg, "Real–Time Scheduling and Computer Accompaniment," *Current Directions in Computer Music Research,* (1989), pp. 225–261.

R. Dannenberg et al., "New Techniques for Enhanced Quality of Computer Accompaniment," *ICMC Proceedings,* (1988), pp. 243–249.

R. Dannenberg et al., "Following an Improvisation in Real Time," *ICMC Proceedings,* ICMA pub., (1987), pp. 241–248.

R. Dannenberg, "An On–Line Algorithm for Real–Time Accompaniment," Copyright 1985 Roger B. Dannenberg, *ICMC '84 Proceedings,* pp. 193–198.

L. Grubb et al., "Automated Accompaniment of Musical Ensembles," *Proceedings of 12th National Conference on Artificial Intelligence,* (1994) pp. 94–99.

J. Lifton, "Some Technical and Aesthetic Considerations in Software for Live Interactive Performance," *ICMC '85 Proceedings,* (1985), pp. 303–306.

M. Puckette et al., "Score following in practice," *ICMC Proceedings,* ICMA pub. (1992), pp. 182–185.

B. Vercoe, "The Synthetic Performer in the Context of Live Performance," *ICMC '84 Proceedings,* (1984), pp. 199–200.

B. Vercoe et al., "Synthetic Rehearsal: Training the Synthetic Performer," *ICMC '85 Proceedings,* (1985), pp. 275–289.

F. Weinstock, "Demonstration of Concerto Accompanist, a Program for the Macintosh Computer," *Demonstration of Concerto Accompanist,* Sep. 1993, pp. 1–3.

INTELLIGENT ACCOMPANIMENT APPARATUS AND METHOD

CROSS REFERENCE TO PARENT APPLICATION

This application is a continuation-in-part of copending U.S. patent application Ser. No. 08/065,831, which was filed May 21, 1993, and which is herein incorporated by reference.

FIELD OF THE INVENTION

The present invention relates to a method and associated apparatus for providing automated accompaniment to a solo performance.

BACKGROUND OF THE INVENTION

U.S. Pat. No. 4,745,836, issued May 24, 1988, to Dannenberg describes a computer system which provides the ability to synchronize to and accompany a live performer. The system converts a portion of a performance into a performance sound, compares the performance sound and a performance score, and if a predetermined match exists between the performance sound and the score provides accompaniment for the performance. The accompaniment score is typically combined with the performance.

Dannenberg teaches an algorithm which compares the performance and the performance score on an event by event basis, compensating for the omission or inclusion of a note not in the performance score, improper execution of a note or departures from the score timing.

The performance may be heard live directly or may emerge from a synthesizer means with the accompaniment. Dannenberg provides matching means which receive both a machine-readable version of the audible performance and a machine-readable version of the performance score. When a match exists within predetermined parameters, a signal is passed to an accompaniment means, which also receives the accompaniment score, and subsequently the synthesizer, which receives the accompaniment with or without the performance sound.

While Dannenberg describes a system which can synchronize to and accompany a live performer, in practice the system tends to lag behind the performer due to processing delays within the system. Further, the system relies only upon the pitch of the notes of the soloist performance and does not readily track a pitch which falls between standard note pitches, nor does the system provide for the weighting of a series of events by their attributes of pitch, duration, and real event time.

Therefore, there is a need for an improved means of providing accompaniment for a smooth natural performance in a robust, effective time coordinated manner that eliminates the unnatural and "jumpy" tendency of the following apparent in the Dannenberg method.

SUMMARY OF THE INVENTION

The present invention provides a system for interpreting the requests and performance of an instrumental soloist, stated in the parlance of the musician and within the context of a specific published edition of music the soloist is using, to control the performance of a digitized musical accompaniment. Sound events and their associated attributes are extracted from the soloist performance and are numerically encoded. The pitch, duration and event type of the encoded sound events are then compared to a desired sequence of the performance score to determine if a match exists between the soloist performance and the performance score. If a match exists between the soloist performance and the performance score, the system instructs a music synthesizer module to provide an audible accompaniment for the soloist. The system provides a method for marking a music sequence data segment to match a musical performance score using a musical instrument digital interface (MIDI) marker message.

A repertoire data file contains music, control, and information segments. The music segments include the music note sequence and preset information; the control segments include music marks, time signature, instrumentation, intelligent accompaniment, and user option information; the information segments include composer biography, composition, performance information, and other terms and symbols. The repertoire file allows the soloist to indicate start and stop points in the play of the music, accompanying instrumentation, or to designate sections of music to be cut or altered in tempo. All of these indications are made by reference to a specific published edition of the music and expressed in the idiom common to musical rehearsal and performance.

DETAILED DESCRIPTION OF THE PREFERRED EMBODIMENTS

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

The present invention provides a system and method for a comparison between a performance and a performance score in order to provide coordinated accompaniment with the performance. A system with generally the same objective is described in U.S. Pat. No. 4,745,836, issued May 24, 1988, to Dannenberg, which is hereby incorporated by reference.

Figure 1:
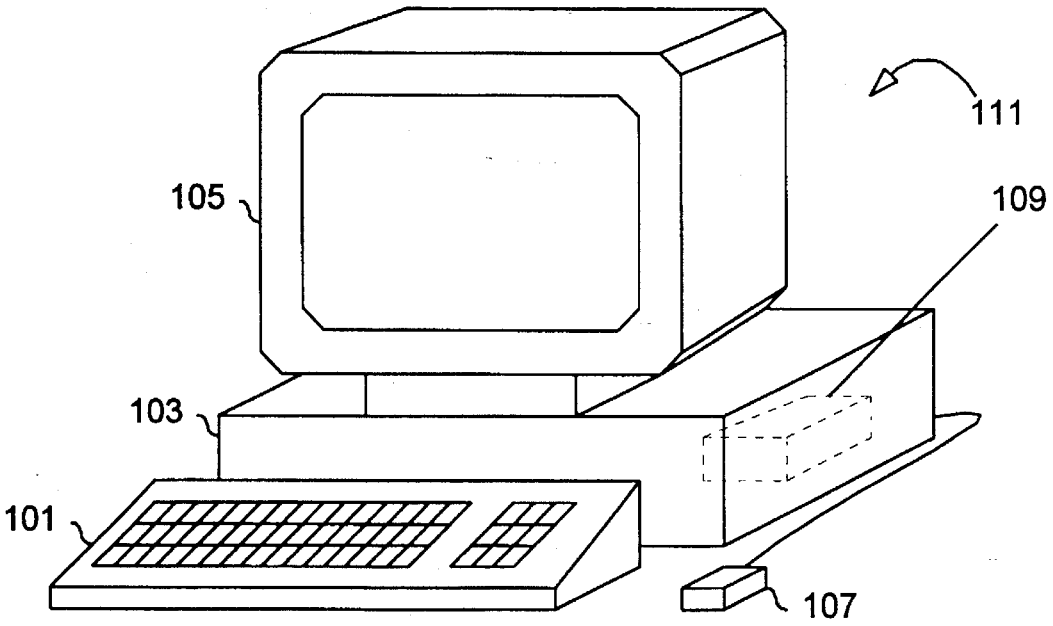
FIG. 1 is a perspective view of the components of a digital computer according to the present invention.

FIG. 1 shows the components of a computer workstation 111 that may be used with the system. The workstation includes a keyboard 101 by which a user may input data into a system, a computer chassis 103 which holds electrical components and peripherals, a screen display 105 by which information is displayed to the operator, and a pointing device 107, typically a mouse, with the system components logically connected to each other via internal system bus within the computer. Intelligent accompaniment software which provides control and analysis functions to additional system components connected to the workstation is executed a central processing unit 109 within the workstation 111.

Figure 2:
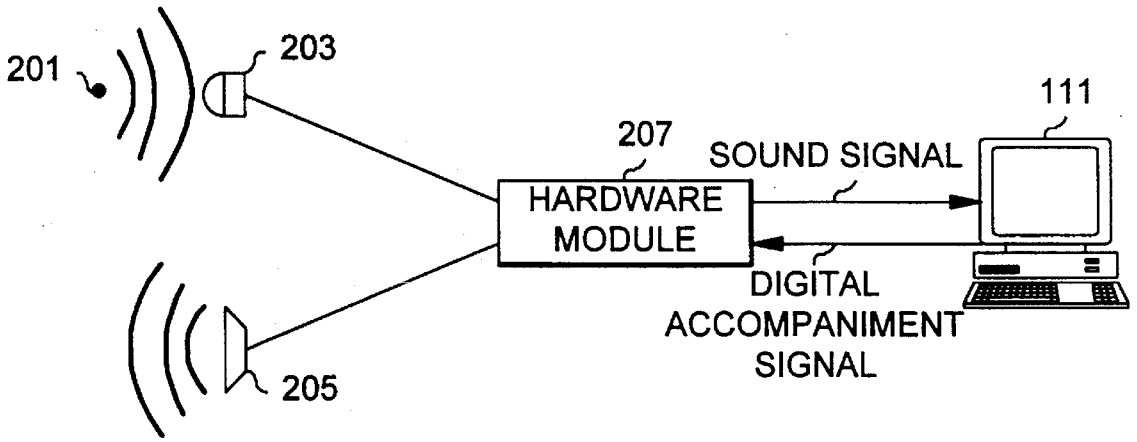
FIG. 2 is a block diagram of the high level logical organization of an accompaniment system according to the present invention.

The workstation 111 is used as part of a preferred intelligent accompaniment (IA) system as shown in FIG. 2. A microphone 203 preferably detects sounds emanating from a sound source 201. The sound signal is typically transmitted to a hardware module 207 where it is converted to a digital form. The digital signal is then sent to the workstation 111, where it is compared with a performance score and a digital accompaniment signal is generated. The digital accompaniment signal is then sent back to the hardware module 207 where the digital signal is converted to an analog sound signal which is then typically applied to a speaker 205. It will be recognized that the sound signal may be processed within the hardware module 207 without departing from the invention. It will further be recognized that other sound generation means such as headphones may be substituted for the speaker 205.

Figure 5:
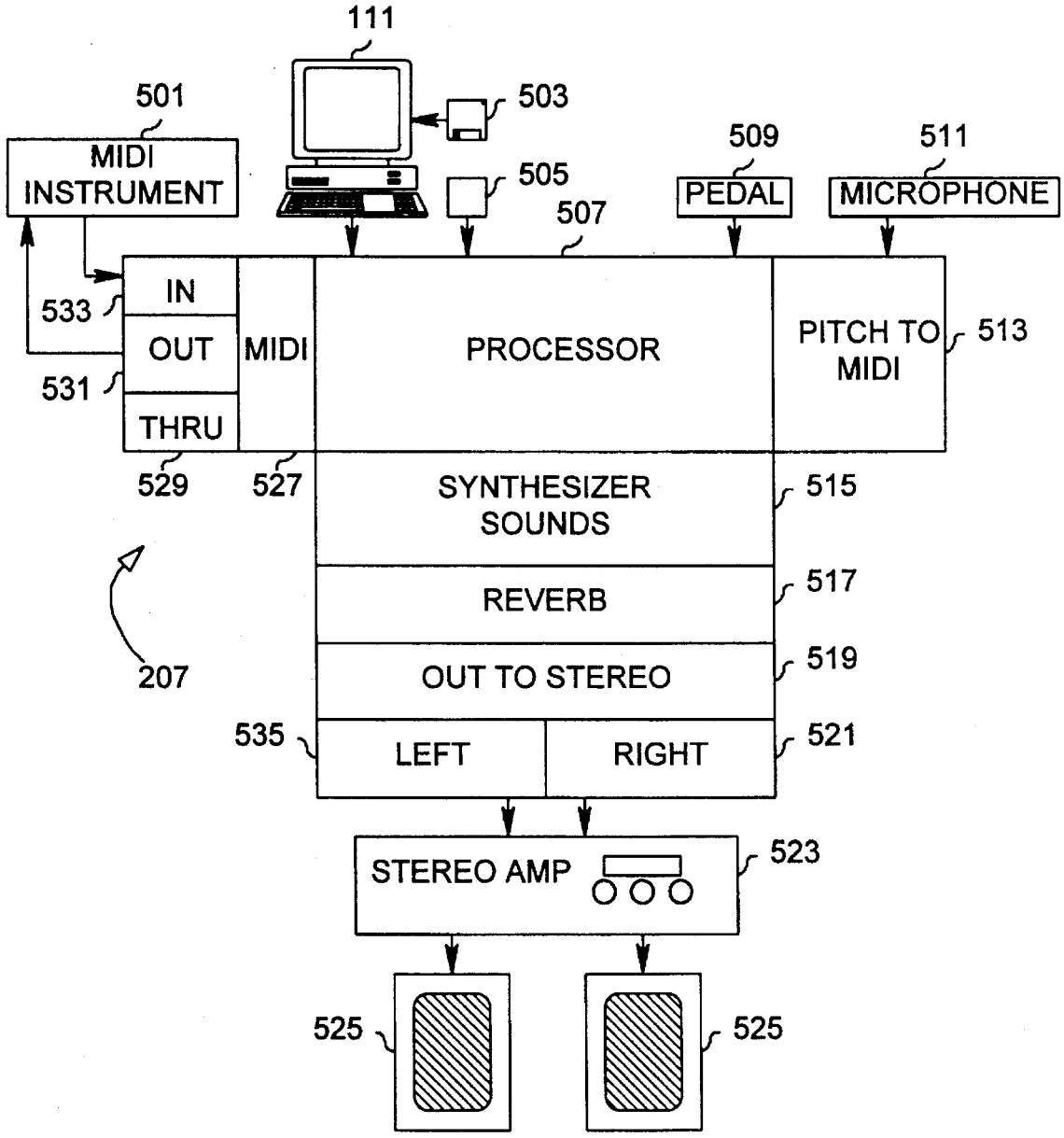
FIG. 5 is a block diagram of the high level hardware organization of an accompaniment system according to the present invention.

A high level view of the hardware module 207 for a preferred IA system is given in FIG. 5. Optionally, a musical instrument digital interface (MIDI) compatible instrument 501 is connected to a processor 507 through a MIDI controller 527 having an input port 533, output port 531, and a through port 529. The MIDI instrument 501 may connect directly to the IA system. Alternatively, a microphone 511 may be connected to a pitch-to-MIDI converter 513 which in turn is connected to processor 507. The workstation 111 is connected to the processor 507 and is used to transmit musical performance score content 503, stored on removable or fixed media, and other information to the processor 507. A data cartridge 505 is used to prevent unauthorized copying of content 503. Once the processor 507 has the soloist input and musical performance score content 503, the digital signals for an appropriate accompaniment are generated and then typically sent to a synthesizer module 515. The synthesizer interprets the digital signals and provides an analog sound signal which has reverberation applied to it by a reverb unit 517. The analog sound signal is sent through a stereo module 519 which splits the signal into a left channel 535 and a right channel 521, which then typically are sent through a stereo signal amplifier 523 and which then can be heard through speakers 525. Pedal input 509 provides an easy way for a user to issue tempo, start and stop instructions.

Figure 3:
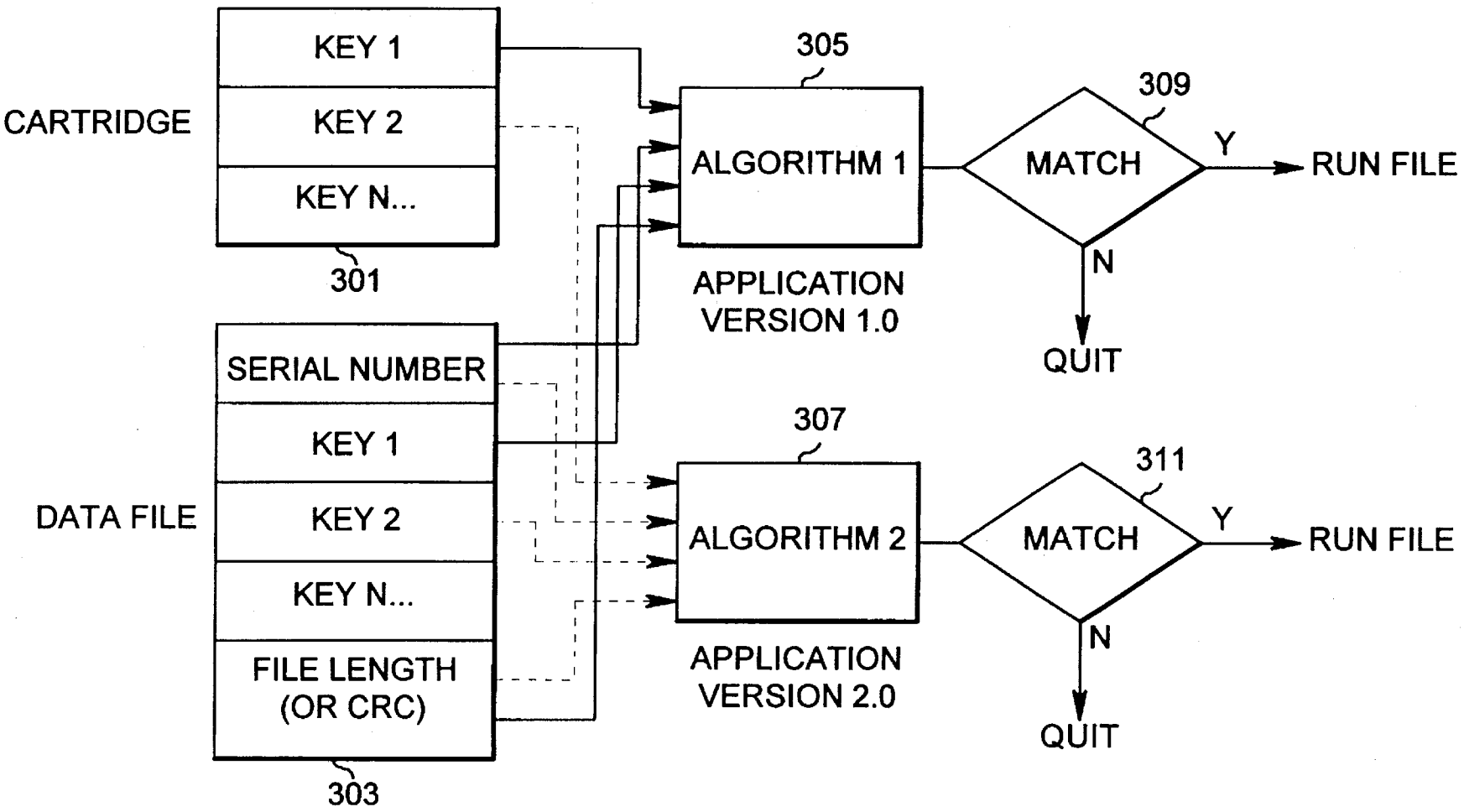
FIG. 3 is a flow diagram showing an encryption key and algorithm selection process according to the present invention.

FIG. 3 illustrates the data protection algorithm used to protect repertoire data content 503 from unauthorized access. A series of data encryption keys 305 to be used with a predetermined number of encryption algorithms 305, 307 are stored within the data cartridge 505. A data file 303, stored in context file 503 contains a serial number value, a file length or cyclical redundancy check (CRC) value, and a predetermined series of target data keys each generated from the serial number and file length or CRC value by each of the encryption data keys 301 and each of the predetermined number of encryption algorithms 305, 307. An application software program executing on the workstation 111 has one of the predetermined number of encryption algorithms 305, 307 encoded within it. When a repertoire data file is to be used, the application software program extracts the serial number and the file length value from it, selects one of the data encryption data keys 301 from the data cartridge, and uses the pre-encoded encryption algorithm 305, 307 contained within the program to generate a resultant key value. At 309, 311 the resultant key value is compared to each of the target key values contained within the data file 303. If one of the target key values matches the resultant key value, the data file is run; otherwise, execution terminates. Accordingly, a new algorithm may be used with each new release of the application software, up to the number of unique keys or in the data cartridge file 301 and file 303. Each new release is backward compatible with exiting files 301 and 303. However, if a file 301 or 303 does not contain a matching key for a newer version of the application, the application will not run. In use, the keys and algorithms are determined prior to the initial release of the application, such that in the initial release files 301 and 303 correspond to future versions of the application with new algorithms.

Figure 6:
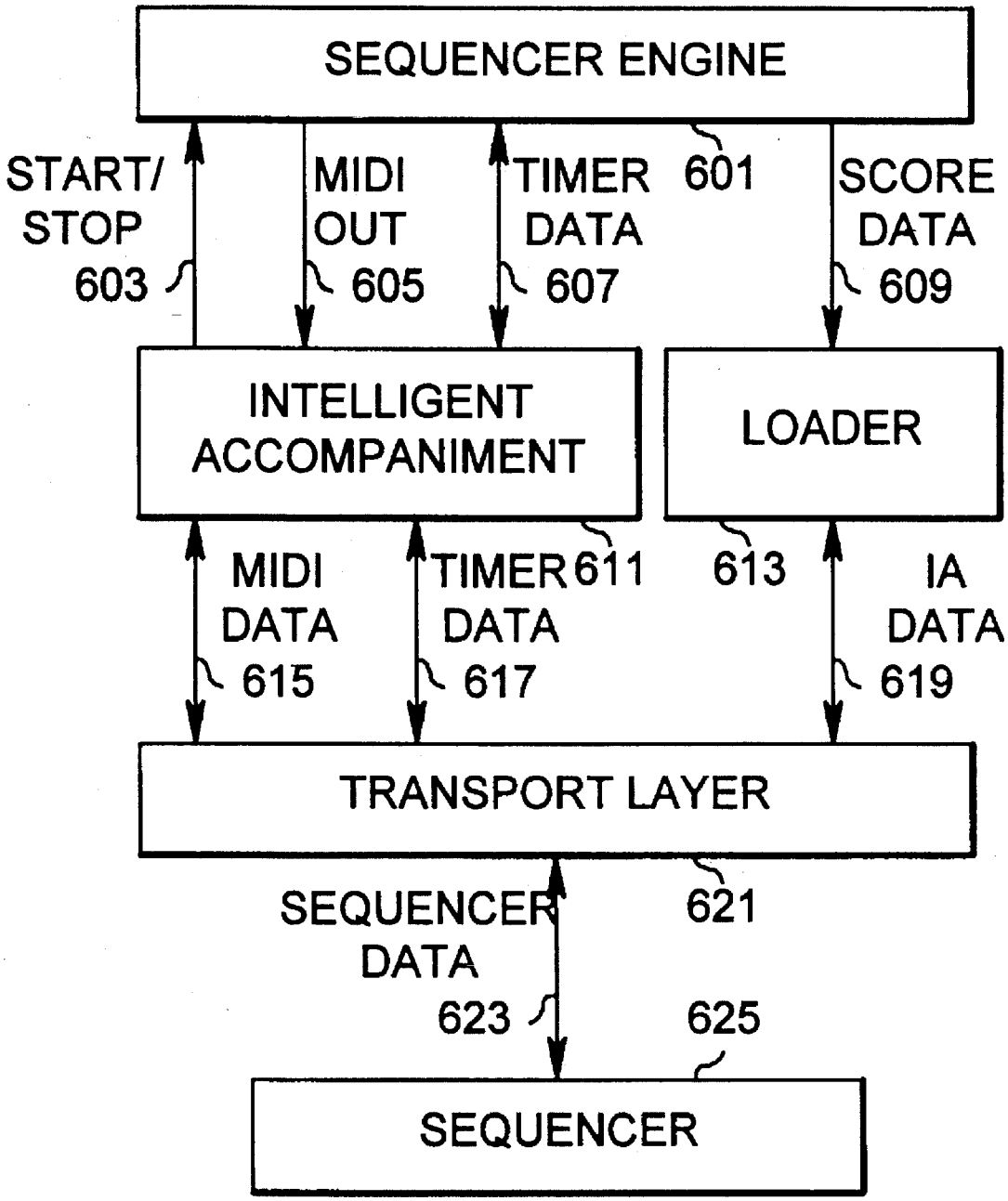
FIG. 6 is a block diagram of a high level data flow overview according to the present invention.

The data flow between logical elements of a preferred IA system is described in FIG. 6. A sequencer engine 601 outputs MIDI data based at the current tempo and current position within the musical performance score, adjusts the current tempo based on a tempo map, sets a sequence position based on a repeats map, and filters out unwanted instrumentation. The sequencer engine 601 typically receives musical note start and stop data 603 and timer data 607 from an IA module 611, and sends corresponding MIDI out data 605 back to the IA module 611. The sequencer engine 601 further sends musical score data 609 to a loader 613 which sends and receives such information as presets, reverb settings, and tunings data 619 to and from the transport layer 621. The transport layer 621 further sends and receives MIDI data 615 and timer data 617 to and from the IA module 611. A sequencer 625 can preferably send and receive sequencer data 623, which includes MIDI data 615, timer data 617, and IA data 619, to and from the IA system through the transport layer 621.

Figure 7:
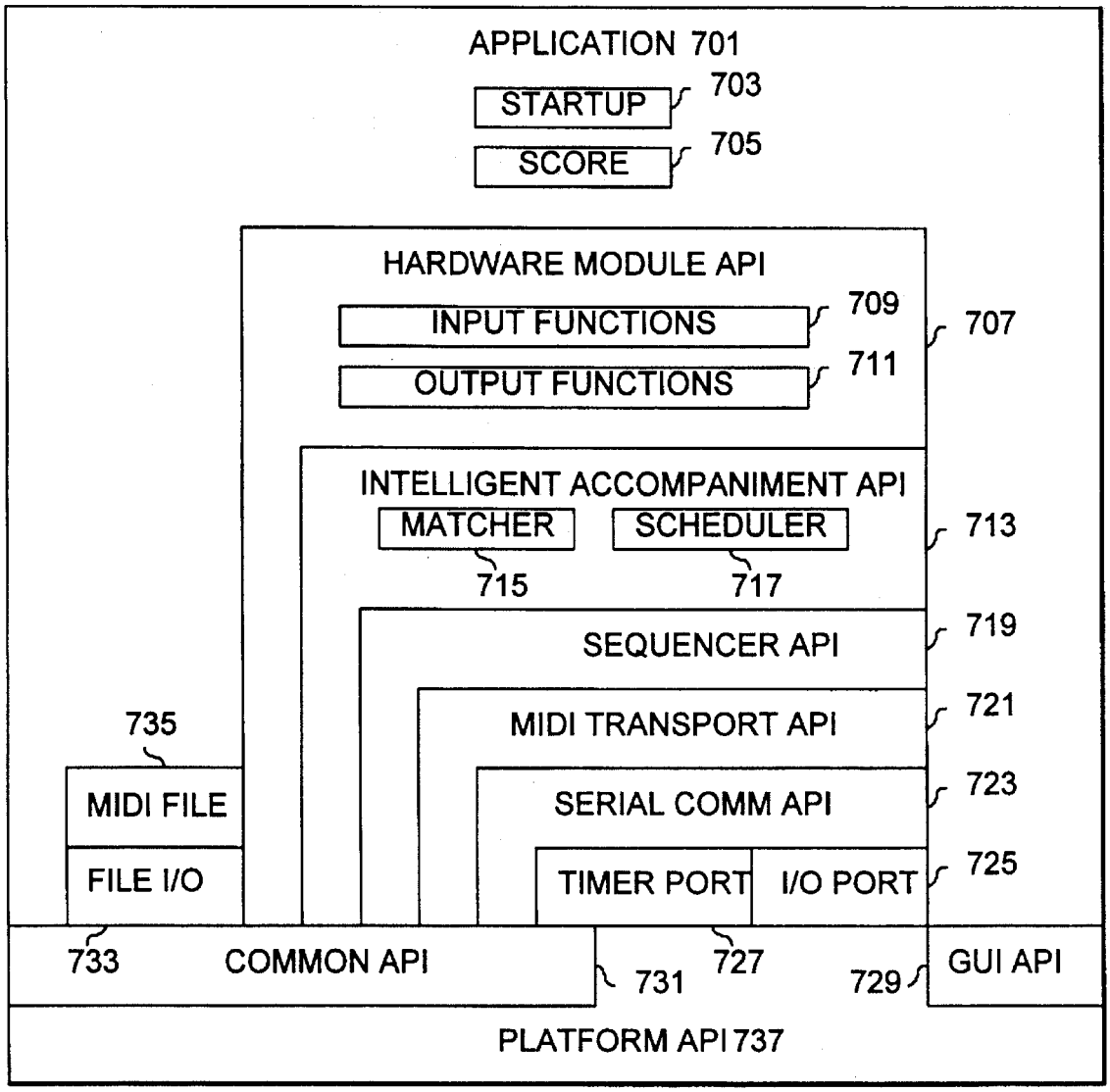
FIG. 7 is a block diagram of a high level interface between software modules according to the present invention.

The interface between the software modules of a preferred IA system is illustrated in FIG. 7. A high level application 701 having a startup object 703 and a score object 705 interact with a graphic user interface (GUI) application program interface (API) 729 and a common API 731. The common API 731 provides operating system functions that are isolated from platform-specific function calls, such as memory allocation, basic file input and output (I/O), and timer functions. A file I/O object 733 interacts with the common API 731 to provide MIDI file functions 735. A platform API 737 is used as basis for the common API 731 and GUI API 729 and also interacts with timer port object 727 and I/O port object 725. The platform API 737 provides hardware platform-specific API functions. A serial communication API 723 interacts with the timer port object 727 and I/O port object 725, and is used as a basis for a MIDI transport API 721 which provides standard MIDI file loading, saving, and parsing functions. A sequencer API 719 comprises a superset of and is derived from the MIDI transport API 721 and provides basic MIDI sequencer capabilities such as loading or saving a file, playing a file including start, stop, and pause functions, positioning, muting, and tempo adjustment. An IA API 713 comprises a superset of and is derived from the sequencer API 719 and adds IA matching capabilities to the sequencer. A hardware module API 707 having input functions 709 and output functions 711 comprises a superset of and is derived from the IA API 713 and adds the hardware module protocol to the object. The IA application 701 is the main platform independent application containing functions to respond to user commands and requests and to handle and display data.

Figure 8:
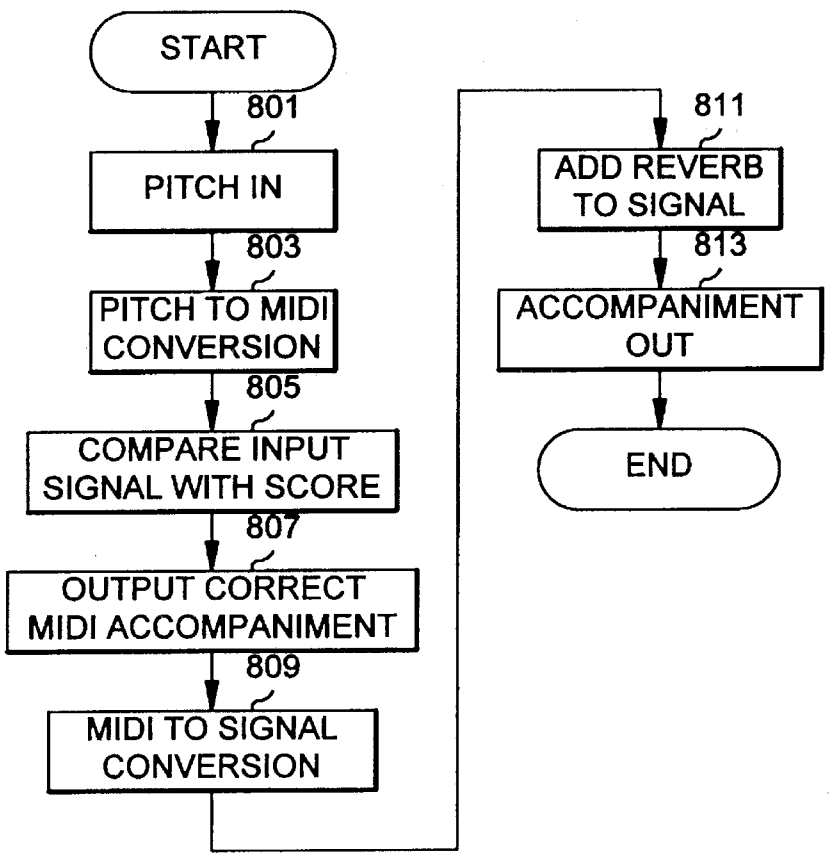
FIG. 8 is a flow diagram of a high level interface between software modules according to the present invention.

FIG. 8 describes the flow control of the overall operation of the preferred IA system shown in FIG. 2. At 801 a pitch is detected by the system and converted to MIDI format input signal at 803. The input signal is sent from the hardware module 207 to the workstation 111 (FIG. 2) and compared with a musical performance score at 805 and a corresponding MIDI accompaniment output signal is generated and output at 807. The MIDI output signal is converted back to an analog sound signal at 809, reverberation is added at 811, and the final sound signal is output to a speaker at 813.

Figure 9:
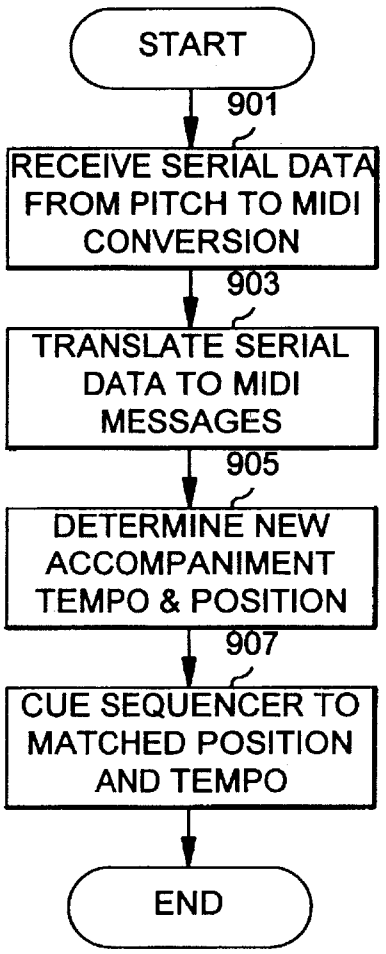
FIG. 9 is a flow diagram of a computerized music data input process according to the present invention.

FIG. 9 shows the input process flow control of FIG. 8. At 901 serial data is received from the pitch to MIDI converter and translated into MIDI messages at 903. A new accompaniment, tempo, and position are determined at 905 and a sequencer cue to the matched position and tempo generated at 907.

Figure 10:
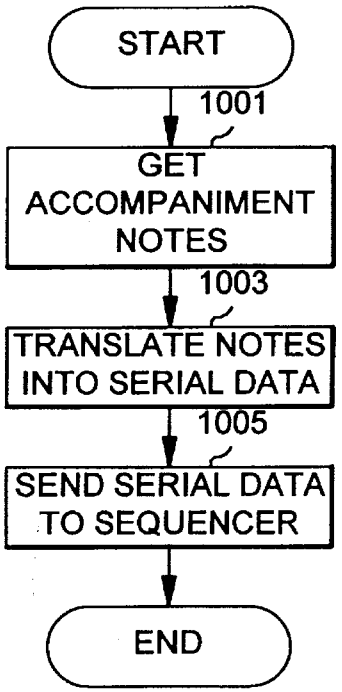
FIG. 10 is a flow diagram of a computerized music data output process according to the present invention.

FIG. 10 shows the output process flow control of FIG. 8. At 1001 accompaniment notes are received and translated into serial data at 1003. The serial data is then sent to the sequencer at 1005.

Figure 11:
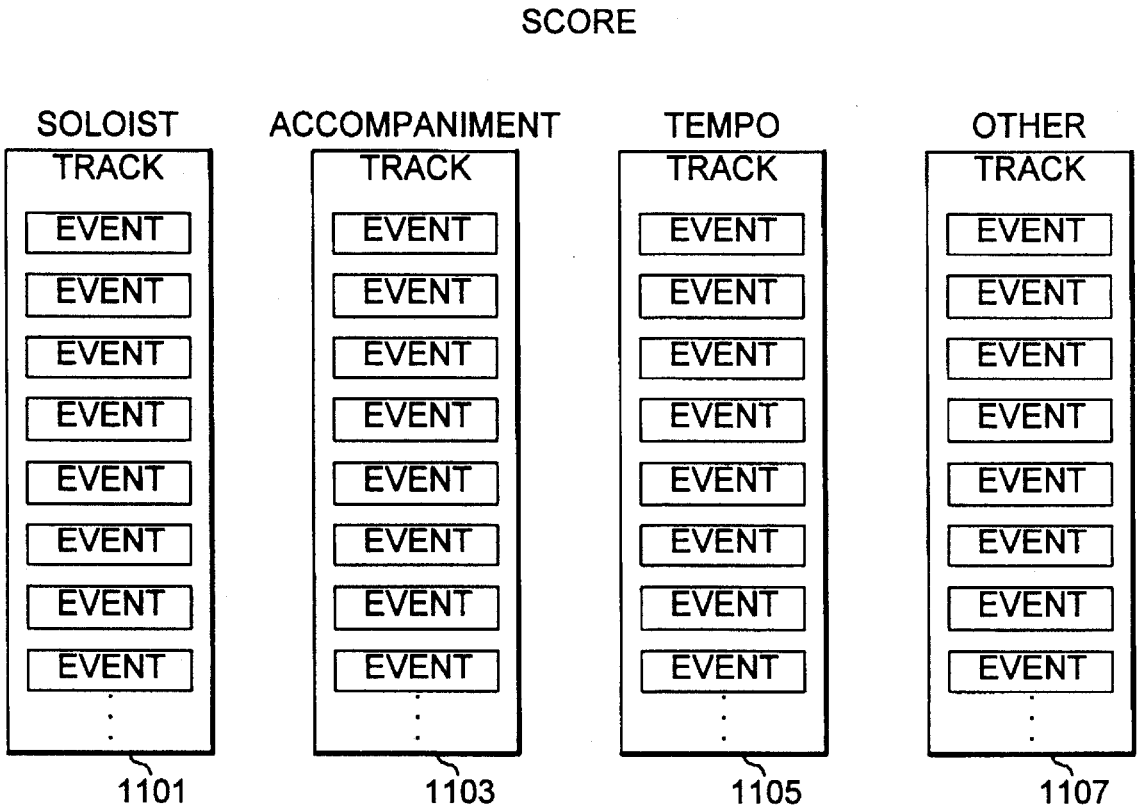
FIG. 11 is a block diagram of data objects for a musical performance score according to the present invention.

FIG. 11 reveals data objects for a musical performance score. A score is divided into a number of tracks which correspond to a specific aspect of the score, with each track having a number of events. A soloist track 1101 contains the musical notes and rests the soloist performer plays; an accompaniment track 1103 contains the musical notes and rests for the accompaniment to the soloist track 1101; a tempo track 1105 contains the number of beats per measure and indicates tempo changes; an other track 1107 contains other events of importance to the score including instrumental changes and rehearsal marks.

Figure 12:
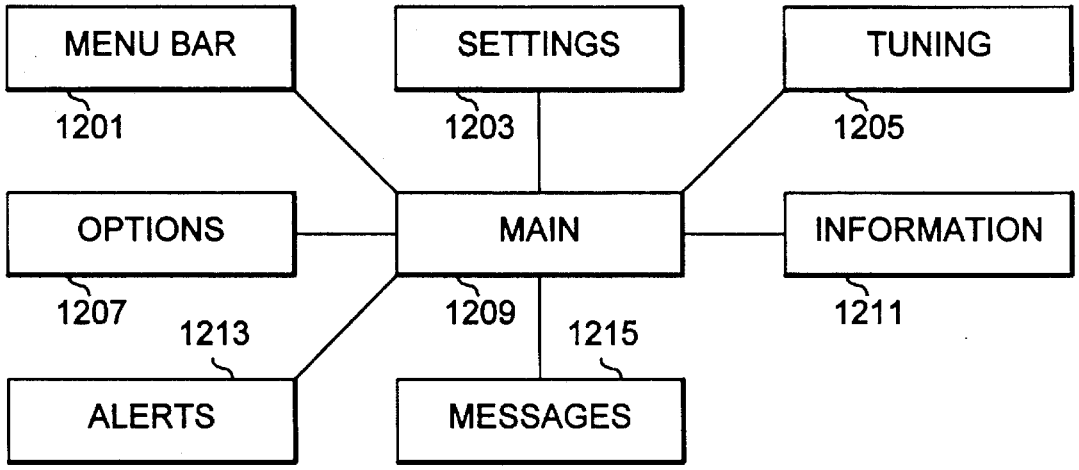
FIG. 12 is a block diagram of main software modules according to the present invention.
Figure 19:
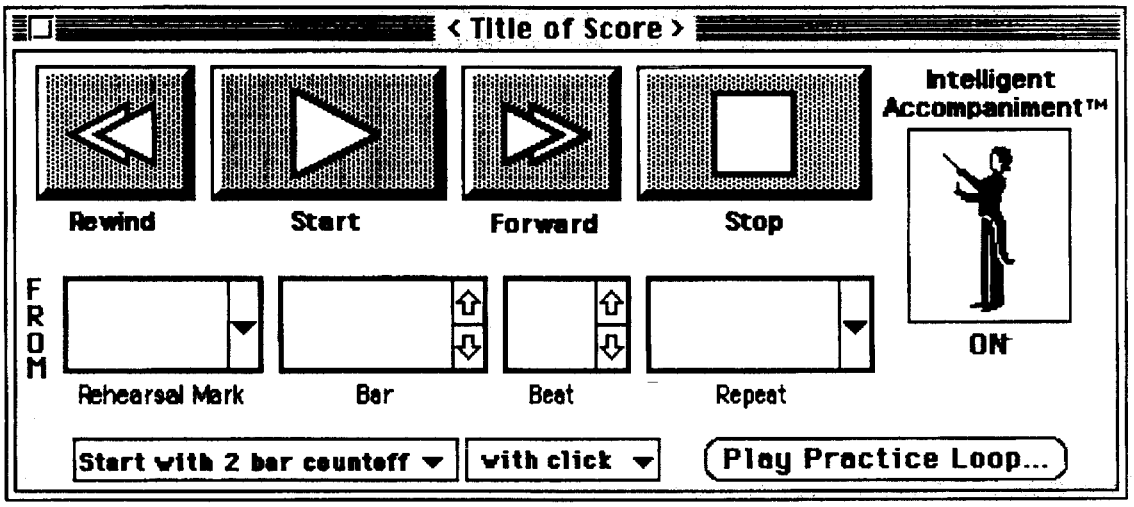
FIG. 19 is a screen display of a main play control window according to the present invention.
Figure 23:
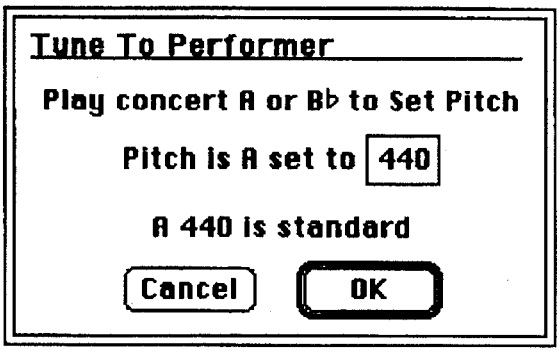
FIG. 23 is a screen display of a tune to performer window according to the present invention.
Figure 22:
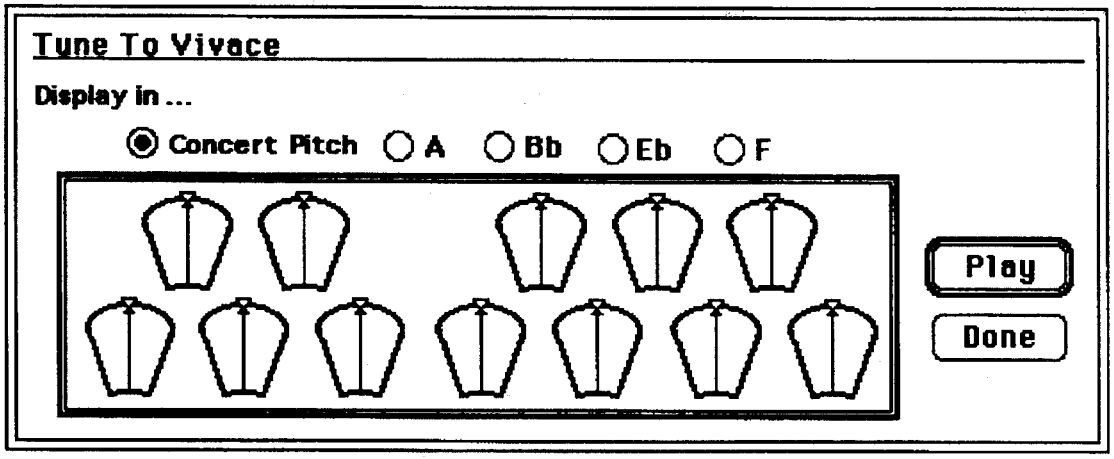
FIG. 22 is a screen display of a tune to accompanist window according to the present invention.
Figure 29:
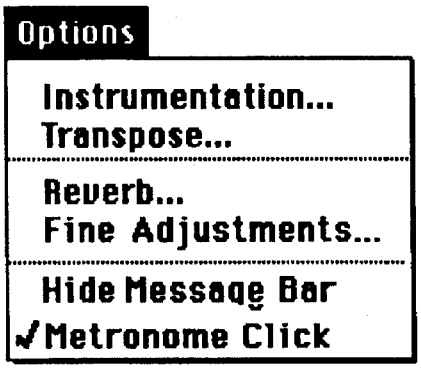
FIG. 29 is a screen display of a user options window according to the present invention.
Figure 35:
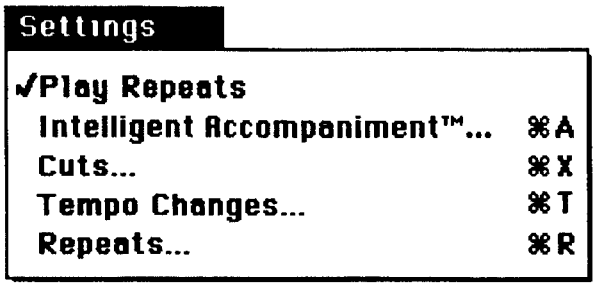
FIG. 35 is a screen display of a settings window according to the present invention.

FIG. 12 shows preferred main software modules. A main play control module 1209 receives user input and invokes appropriate function modules in response to selections made by the user, as shown in FIG. 19. Because the preferred software uses a GUI, the display modules are kept simple and need only invoke the system functions provided by the windowing system. A system menu bar 1201 provides operating system control functions; a settings module 1203 allows the editing of system settings as shown in FIG. 35; a tuning module 1205 allows a soloist to tune to the system as shown in FIG. 22, or the system to tune to the soloist as shown in FIG. 23; an options module 1203 allows the editing of user settings as shown in FIG. 29; an information module 1211 provides information about the system; an alerts module 1213 notifies a user of any alerts; and a messages module 1215 provides system messages to the user. The source code for the software modules programmed into the workstation is attached in the microfiche appendix. The software is written in the 'C' programming language and runs on Apple Macintosh computers.

Figure 13:
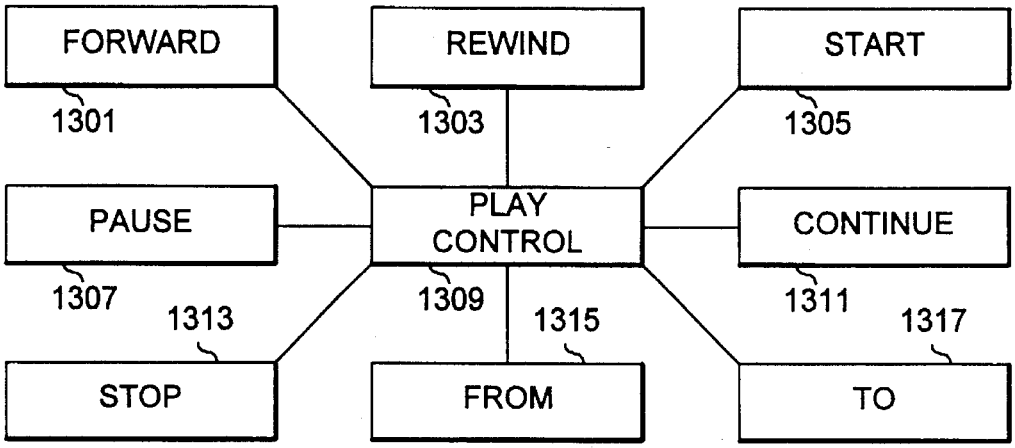
FIG. 13 is a block diagram of play control software modules according to the present invention.
Figure 20:
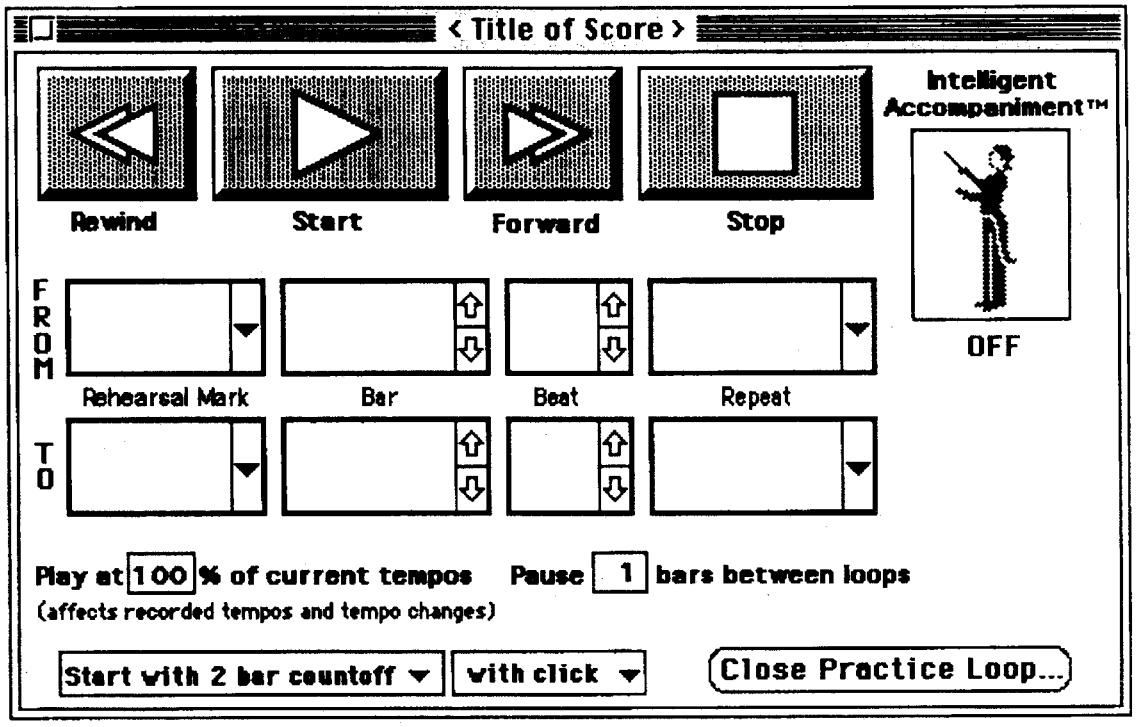
FIG. 20 is a screen display of a main play control loop window with practice loop controls according to the present invention.
Figure 49:
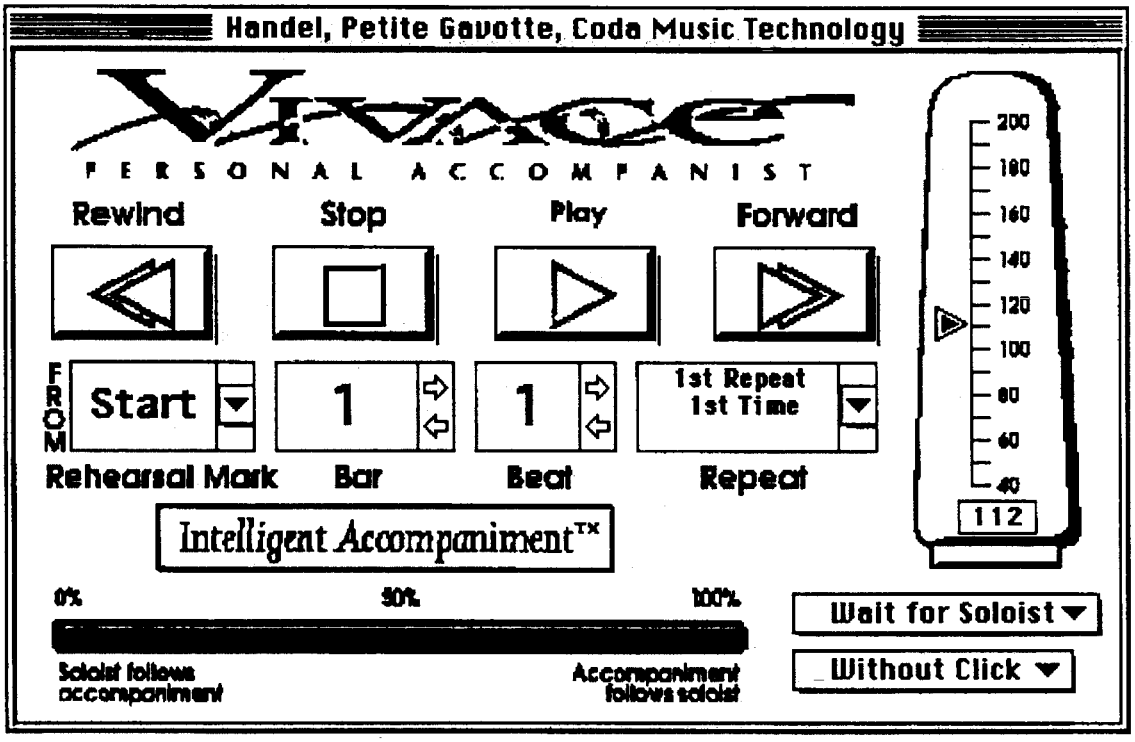
FIG. 49 is a screen display of a main play control loop window according to the present invention.

FIG. 13 shows a preferred play control software module. A main play control module 1309 receives program commands and invokes specialized play functions as appropriate in response to selections made by the user, as shown in FIG. 19. The play control module 1309 provides play and positioning functions similar in concept to well-known cassette tape players. Positioning functions include forward 1301 and rewind 1303. Play functions include start 1305, pause 1307, continue 1311, and stop 1315. Functions to control which section of the score is to be played as a practice loop as shown in FIG. 20 and FIG. 49 include a 'from' function 1315 and a 'to' function 1317, wherein a user may specify a rehearsal mark, bar, beat, or repeat.

Figure 14:
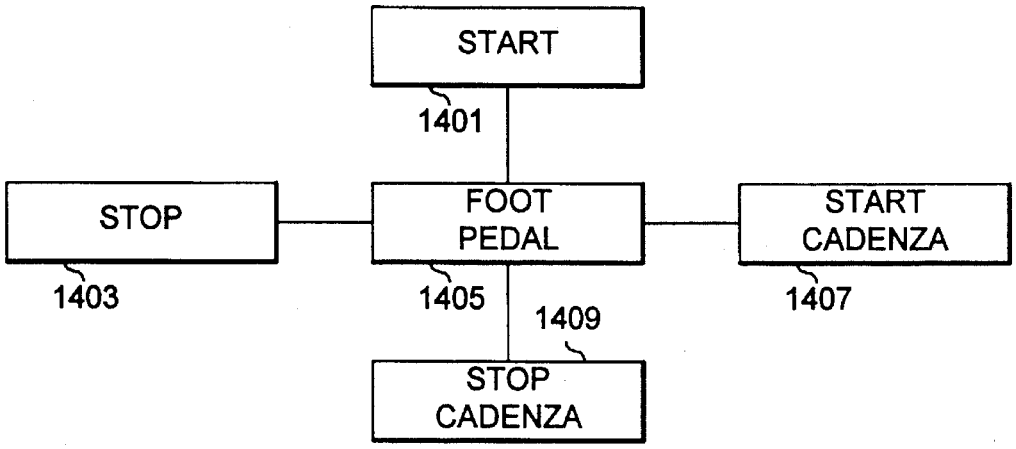
FIG. 14 is a block diagram of foot pedal software modules according to the present invention.

FIG. 14 shows a preferred foot pedal control software module. The module controls an optional foot pedal 509 (FIG. 5) which may be attached to the system allowing an easy way for a user to issue tempo, start and stop instructions. A main foot pedal module 1405 receives program commands and invokes specialized foot pedal functions start 1401, stop 1403, start cadenza 1407, and stop cadenza 1409 as appropriate in response to selections made by the user.

Figure 15:
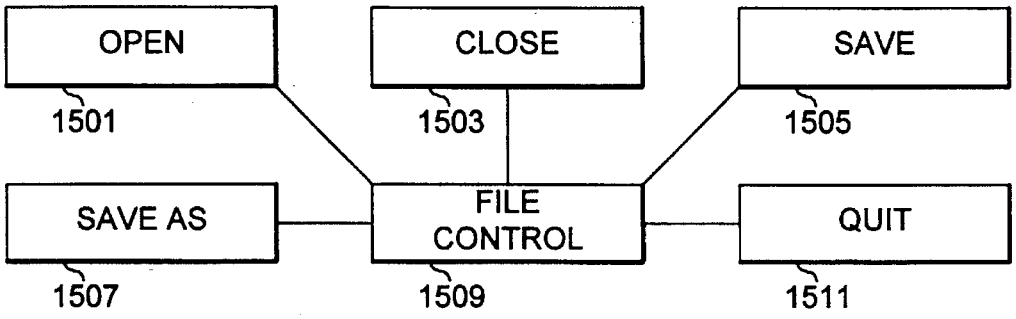
FIG. 15 is a block diagram of file control software modules according to the present invention.

FIG. 15 shows a preferred file control software module. It will be recognized that file functions may be provided by either a built-in operating system function or by a module located within the applications software. A main file control module 1509 receives program commands and invokes specialized file functions open 1501, close 1503, save 1505, save as 1507, and quit 1509 as appropriate in response to selections made by the user.

Figure 16:
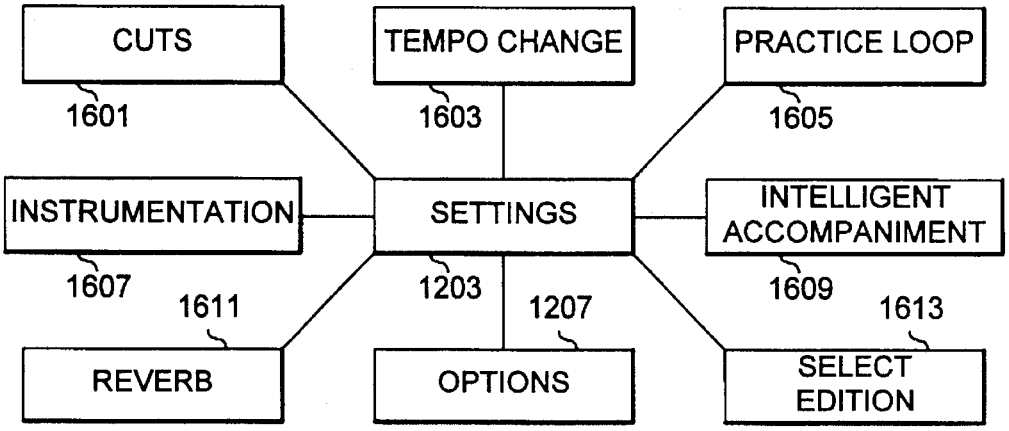
FIG. 16 is a block diagram of settings software modules according to the present invention.
Figure 21:
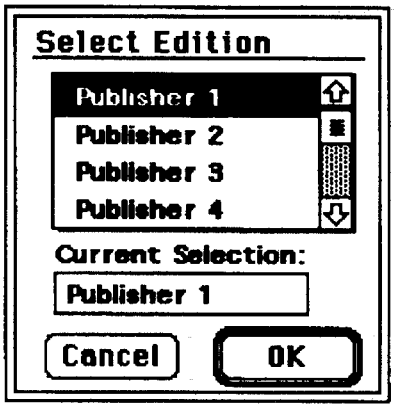
FIG. 21 is a screen display of a select edition window according to the present invention.
Figure 24:
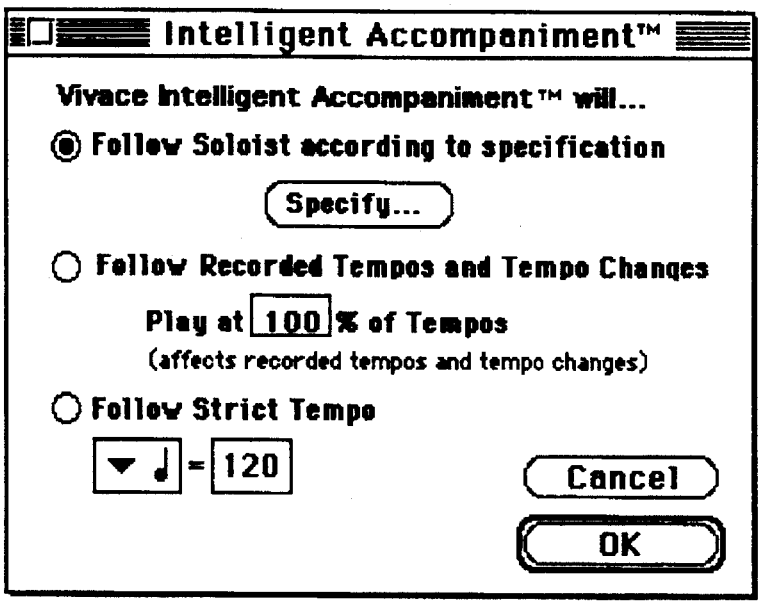
FIG. 24 is a screen display of an intelligent accompaniment selection window according to the present invention.
Figure 25:
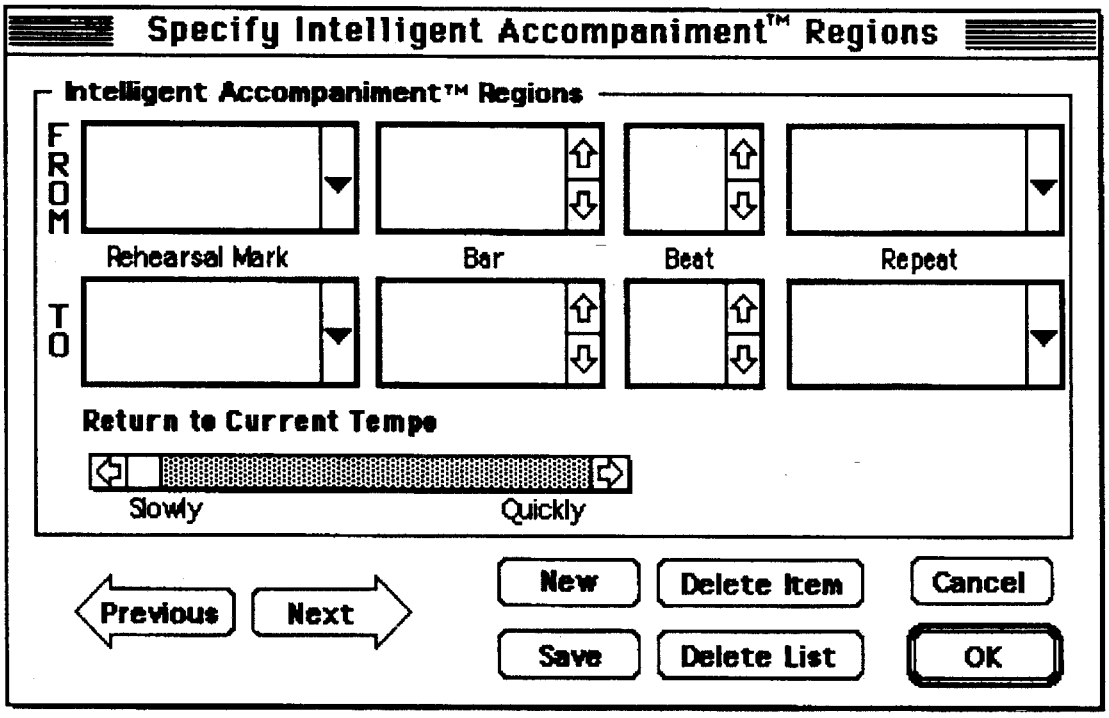
FIG. 25 is a screen display of a specify intelligent accompaniment regions window according to the present invention.
Figure 26:
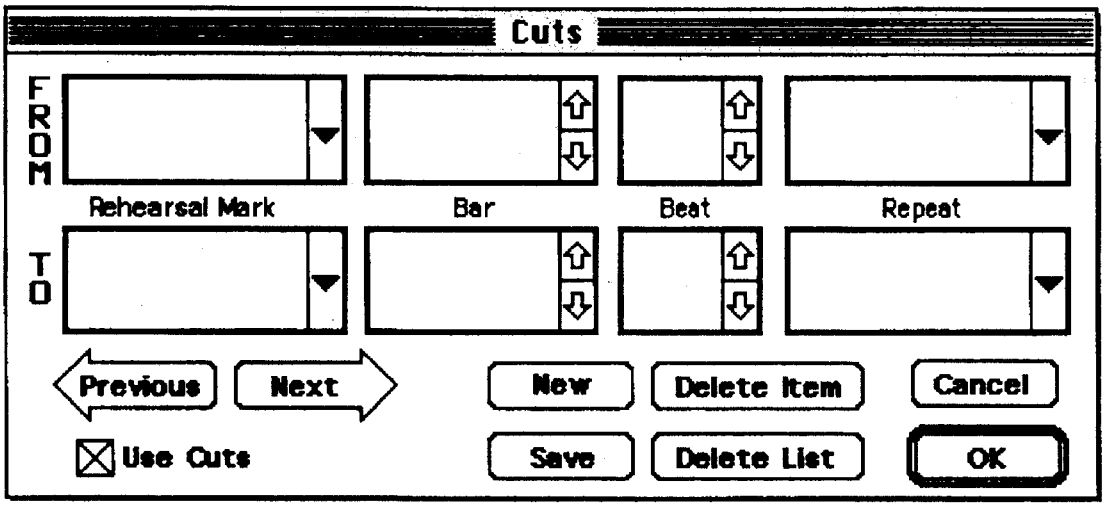
FIG. 26 is a screen display of a cuts window according to the present invention.
Figure 27:
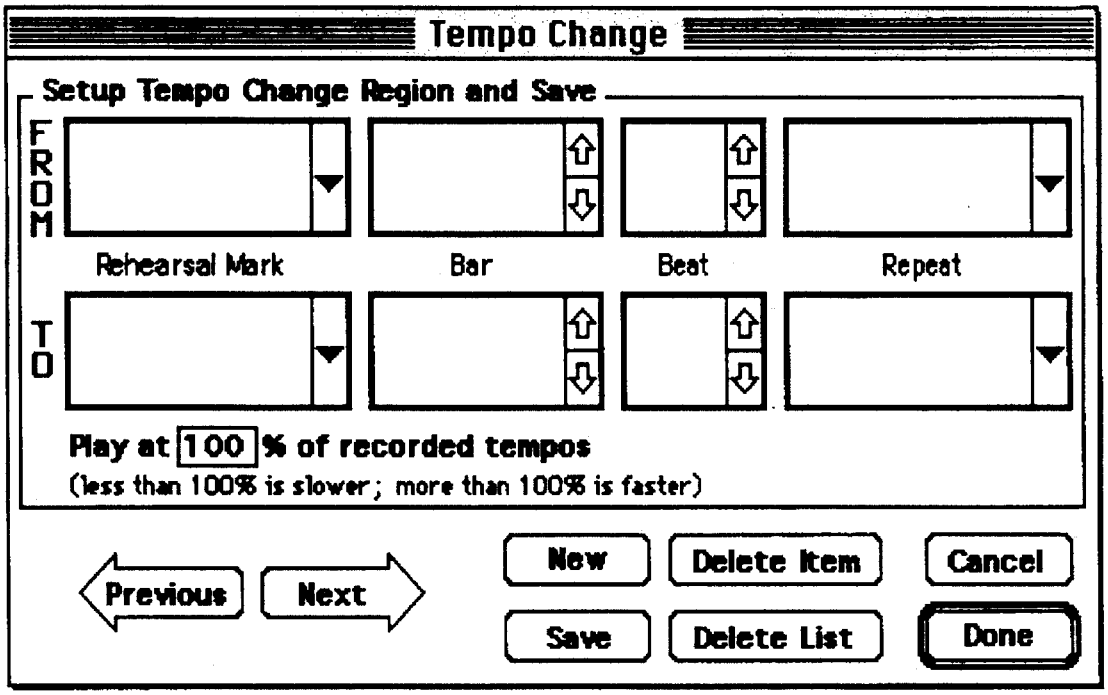
FIG. 27 is a screen display of a tempo change window according to the present invention.
Figure 28:
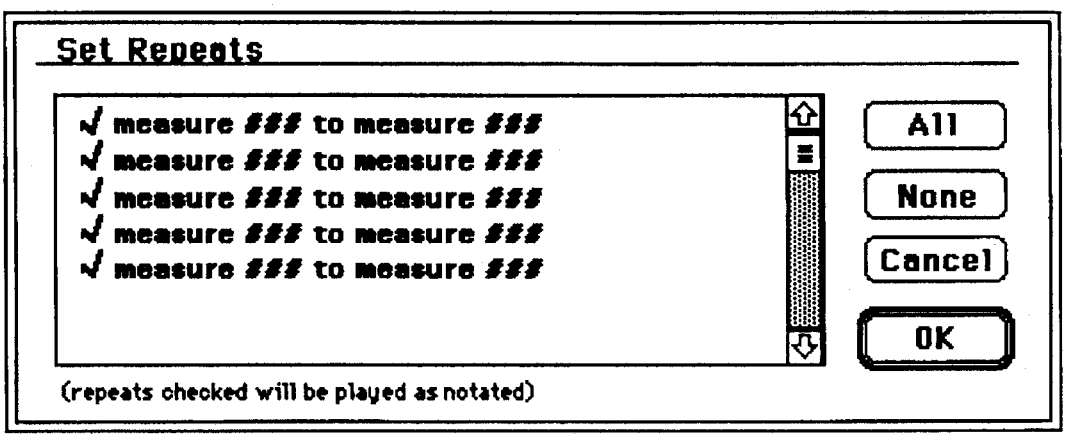
FIG. 28 is a screen display of a set repeats window according to the present invention.
Figure 30:
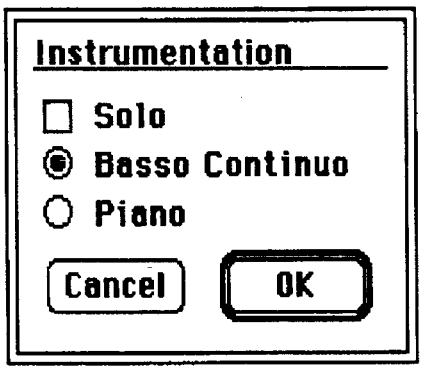
FIG. 30 is a screen display of an instrumentation window according to the present invention.
Figure 31:
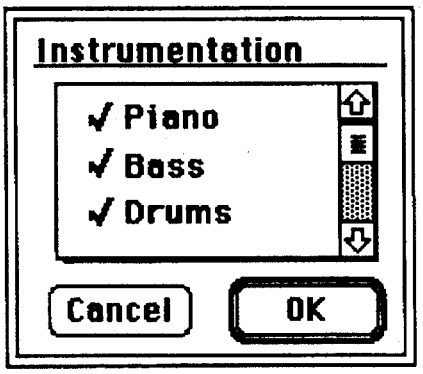
FIG. 31 is a screen display of a jazz instrumentation window according to the present invention.
Figure 33:
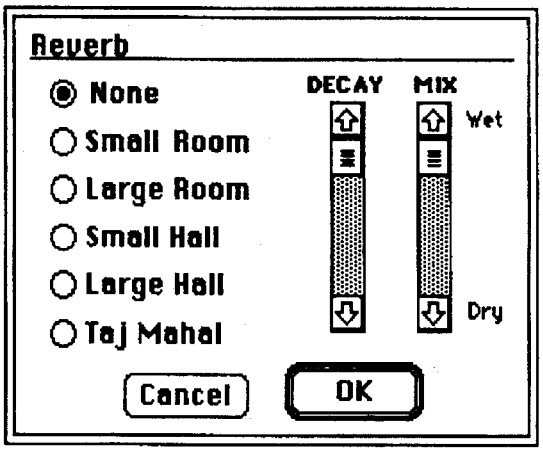
FIG. 33 is a screen display of a reverb window according to the present invention.

FIG. 16 describes a preferred settings software module. The settings module allows the editing of various parameters which govern the stylistic and accompaniment aspects of the system as shown in FIG. 35. The main settings module 1203 receives program commands and invokes a cuts module 1601, as shown in FIG. 26, to specify which sections of the musical performance score are not to be played; a tempo change module 1603 which sets which sections of the score are to be played at a faster or slower tempo than the predetermined tempo as shown in FIG. 27; a practice loop module 1605 allowing a user to specify a range of measures that will automatically repeat as shown in FIG. 20 and FIG. 49; an instrumentation module 1607 allowing a user to select differing instrumentations for jazz idioms as shown in FIG. 31, and non jazz idioms as shown in FIG. 30; an IA module 1609 as shown in FIG. 24 to enable and select an IA setting of either follow a performer according to specification, follow recorded tempos and changes, or follow strict tempo; a reverberation function 1611 allowing a user to select the amount and quality of reverberation echo to automatically be added to the generated accompaniment sounds as shown in FIG. 33; a user options module 1207 allowing a user to change performance and software features as shown in FIG. 29; and a select edition module 1613 allowing a user to choose a particular version of a musical performance score to play with as shown in FIG. 21.

Figure 17:
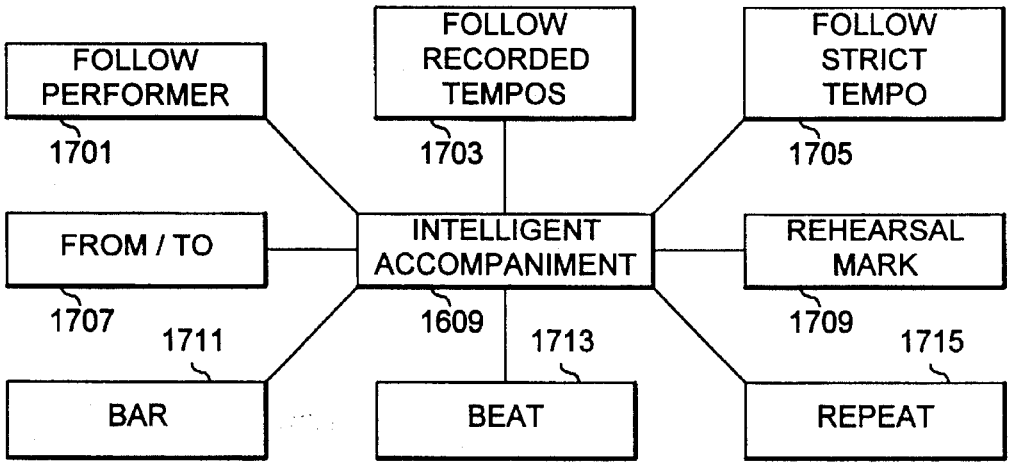
FIG. 17 is a block diagram of intelligent accompaniment software modules according to the present invention.

FIG. 17 describes a preferred IA software module. The IA module allows the editing of various parameters which govern the stylistic and accompaniment aspects of the system. The main IA module 1609 as shown in FIG. 24 allows a user to enable and select an IA setting of either follow a performer according to specification 1701, follow recorded tempos and changes 1703, or follow strict tempo 1705. A user may further select practice loop from/to functions 1707, wherein a user may specify a rehearsal mark 1709, bar 1711, beat 1713, or repeat 1715 as shown in FIG. 20 and FIG. 49.

Figure 18:
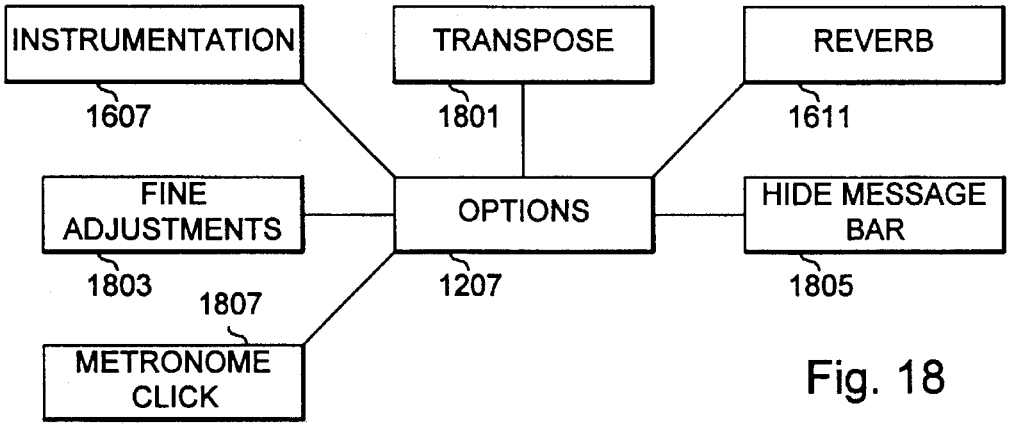
FIG. 18 is a block diagram of user options software modules according to the present invention.
Figure 32:
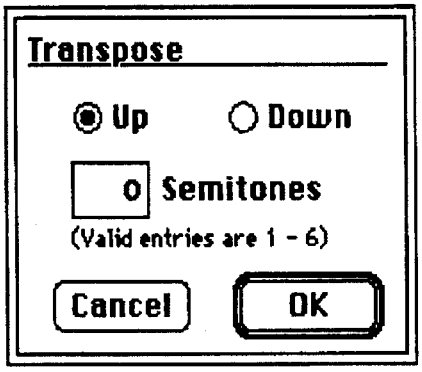
FIG. 32 is a screen display of a transpose window according to the present invention.
Figure 34:
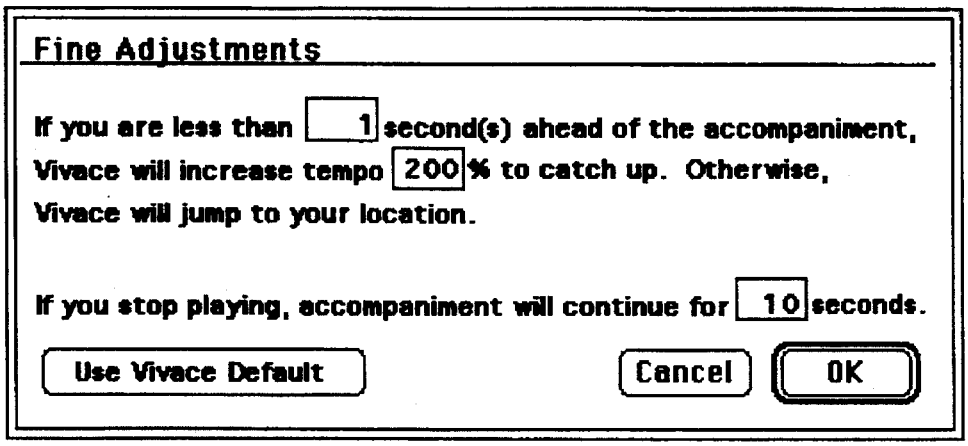
FIG. 34 is a screen display of a fine adjustments window according to the present invention.

FIG. 18 illustrates a preferred user options software module, displayed to the user as shown in FIG. 29. The IA module allows the editing of various parameters which govern the stylistic and accompaniment aspects of the system. The main user options module 1207 receives program commands and invokes an instrumentation module 1607 allowing a user to select differing instrumentations for jazz idioms as shown in FIG. 31, and non jazz idioms as shown in FIG. 30; a transpose module 1801 for transposing all transposable channels up or down a selected number of semitones as shown in FIG. 32; a reverberation function 1611 allowing a user to select the amount and quality of reverberation echo to automatically be added to the generated accompaniment sounds as shown in FIG. 33; a fine adjustments module 1803 for specifying either speeding up or jumping to the performer's current position within the score, and for setting the amount of time to provide accompaniment if the performer stops playing, as shown in FIG. 34; a hide message bar function 1805 to inhibit the display of messages to the user; and a metronome click function 1807 to enable or disable an audible click at a set tempo.

Because of a hardware processing delay in the conversion of notes of the soloist performance into MIDI data, an automated accompaniment system, if uncorrected, will always lag behind the performer by the amount of the pitch-to-MIDI conversion delay. The intelligent accompaniment of the present invention corrects for a pitch-to-MIDI conversion delay or other system delays by altering the accompaniment in real-time based upon the post-processing of past individual events of the soloist performance. Each event $E_t$ is time-stamped by the hardware module 207 (FIG. 2) so the system knows when the event occurred. In addition, a time value At is supplied by the hardware module 207 which represents the time difference between when a sound was first detected and when it is finally sent from the hardware module 207 to the workstation 111. Thus, to synchronize with the soloist and provide an accompaniment at the correct time, the system calculates the correct time $T_c$ to be: $T_c=E_t+\Delta t$, then uses $T_c$ as the place in the musical performance score where the soloist is now projected to be. The system outputs the appropriate notes at point $T_c$ in the musical score as the accompaniment.

Figure 4:
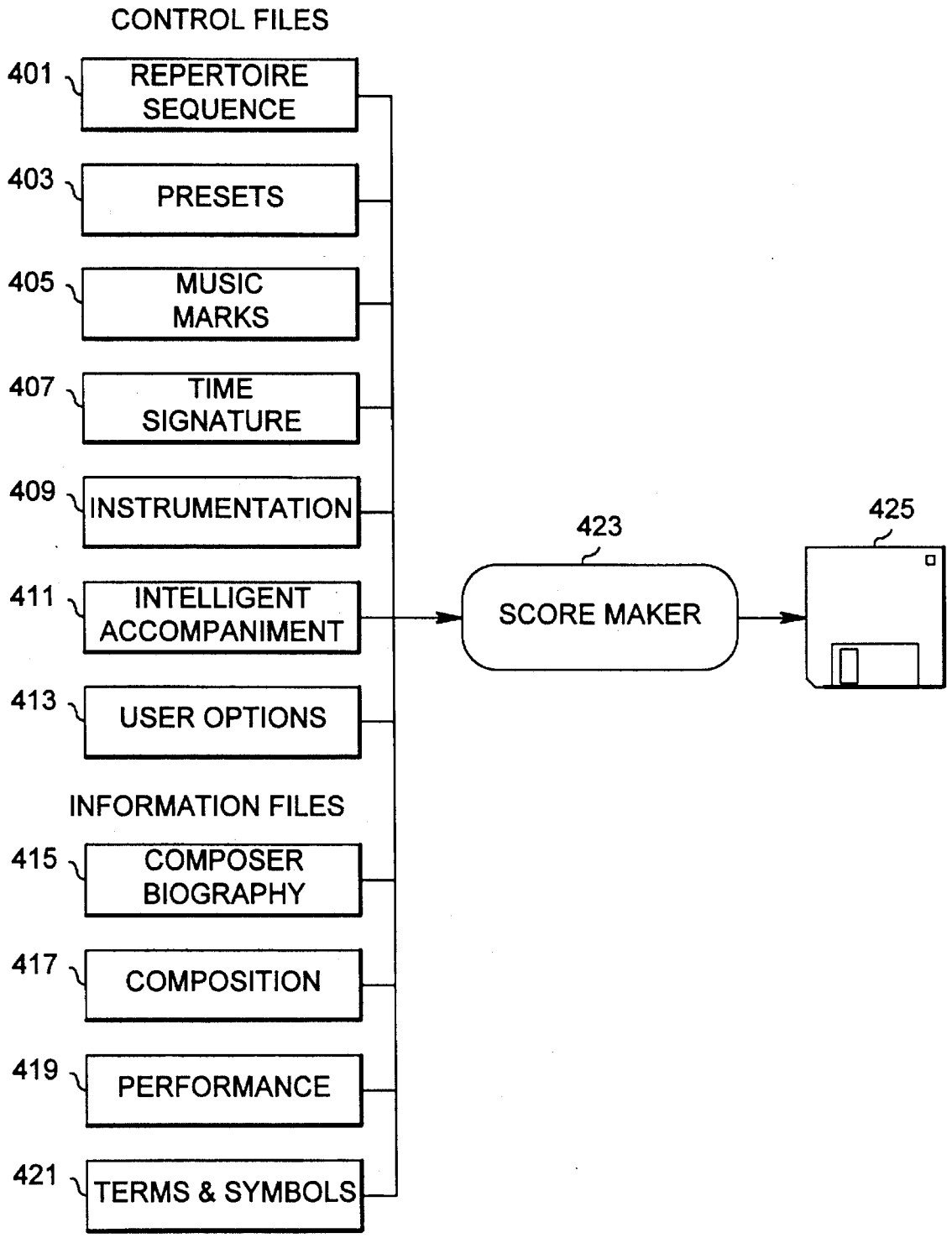
FIG. 4 is a block diagram of a file structure according to the present invention.

A repertoire file is preferably composed of a number of smaller files as shown in FIG. 4. These files are typically tailored individually for each piece of music. The files are classified as either control files or information files. The control files used by the application are preferably a repertoire sequence file 401 for the actual music accompaniment files, a presets file 403 for synthesizer presets, a music marks file 405 for rehearsal marks and other music notations, a time signature file 407 for marking the number of measures in a piece, whether there is a pickup measure, where time signature changes occur, and the number of beats in the measure as specified by the time signature, an instrumentation file 409 to turn accompanying instruments on or off, an intelligent accompaniment file 411 to set the default regions for intelligent accompaniment on or off (where in the music the accompaniment will listen to and follow the soloist), and a user options file 413 to transpose instruments and to set fine adjustments made to the timing mechanisms. The information files used by the application are preferably a composer biography file 415 for information about the composer, a composition file 417 for information about the composition, a performance file 419 containing performance instructions, and a terms and symbols file 421 containing the description of any terms used in the piece. A computerized score maker software tool 423 makes the musical performance score and assembles all control and information data files into a single repertoire file 425.

A repertoire sequence file 401 for a score is preferably in the standard MIDI Type 1 format. There are no extra beats inserted into the MIDI file to imitate tempo increases or decreases. The score maker software tool 423 typically does not perform error checking on the format of the MIDI data. There is only one repertoire sequence file per score.

A presets data file 403 for a score is preferably in the standard MIDI Type 1 file format. The presets are downloaded to the hardware module 207 (FIG. 2) for each score. No error checking is typically done on the format of the presets data file.

A music marks data file 405 is preferably created with any standard text processing software and the format of the file typically follows the following conventions:

1. There can be any number of rehearsal marks per file.
2. Any pickup notes that come before the first measure of the score are ignored. The first measure of a score is always Measure 1. Pickup notes are considered to be in measure 0.
3. Rehearsal marks appear on the screen exactly as they appear in the text file.
4. All fields must be entered and there must be a comma between each field. Each rehearsal mark is on a separate line within the file.
5. Rehearsal marks apply to only one edition, not the entire score file. Each edition can have a separate set of rehearsal marks or none at all. A single rehearsal mark consists of a rehearsal mark field, which is up to two printable characters, and a starting measure, which is the number of measures from the beginning of the score the rehearsal mark starts at.

A typical example of a rehearsal marks file is given below:

AA,1
B,5
23,25
cS,40
% *,50
q),90

Repeat information for the music marks data file 405 is preferably created with any standard text processing software and the format of the file typically follows the following conventions:

6. There can only be one Dal Segno (DS) or one Da Capo (DC). There may be none but not both.
7. Rehearsal letters cannot be used to indicate where a repeat starts and ends in the score. The starting and ending measures are relative to the beginning of the score.
8. The ending measure for a DC or DS will be where the Coda is in the music. This will be the last measure played before jumping to the Coda, not the measure that immediately follows the Coda.
9. All fields must be entered and there must be a comma between each field. Each repeat is on a separate line within the file. The repeats data preferably consists of the following fields:

Field 1. This field is the type of repeat and can only be one of the following: R, DC, or DS. Capital letters, all lowercase or mixed may be used. R is a plain musical repeat of some number of measures. DC and DS are Da Capo and Dal Segno, respectively.

Field 2. This field is the number of times the repeat section is taken; normally one, always one for a DC or DS.

Field 3. This field is the measure the repeat/DS/DC starts at. This is the first measure that is played as part of the section. The DC will almost always be 1, and the DS will be the measure with a segment number.

Field 4. This field is the end measure of the repeat/DS/DC.

Field 5, 6, etc. These fields are utilized to designate the number of measures (length in measures) in the alternate endings that a repeat might have.

Some typical examples of repeats are given below:

| Repeat: | Comment: |
|---|---|
| r, 1,10,11,0 | There is a repeat, taken once (i.e. repeat is played), at measure 10, ending at measure 11, with 0 measures in an alternate ending (there is no alternate ending). |
| r, 1,10,11,1,1 | There is a repeat, taken once (i.e. repeat is played), at measure 10, ending at measure 11, with 1 measure in the first ending and 1 measure in the 2nd ending. |
| r, 1,10,11,1,1,1 | There is a repeat, taken once (i.e. repeat is played), at measure 10, ending at measure 11, with 1 measure in the first ending and 1 measure in the 2nd ending, and 1 measure in the third. |

A time signature data file 407 that will be used to specify how many measures are in a piece, whether it contains a pickup measure (anacrusis), how many beats the pickup notes include, what measure a time signature change occurs, and how many beats are in that measure, is preferably created with any standard text processing software and the format of the file typically follows the following conventions:

1. There typically can be up to 999 measures per file. The first measure of a score is always Measure 1. The first record of the time signature file indicates how many measures long the score is, not counting any repeats.

2. Pickup measures are indicated by measure zero (0). Pickup notes are considered to be in measure 0.
3. For pickup measures, the number of beats included in pickup note(s) is specified.
4. There can be any number of time signature changes per file.
5. Each record typically consists of two fields. All fields must be entered and there must be a comma between each field. Each time signature change goes on a separate line in the file. There must be a carriage return after each line, including the last line in the file.

A typical example of a time signature data file is given below:

| Line: | Comment: |
|---|---|
| 0,100 | The first field is always 0, this piece is 100 measures long. |
| 0,1 | This piece has a pickup measure (0) with the pickup note(s) in one beat. |
| 1,4 | All pieces start at measure 1. This piece begins with four beats in the time signature of 4/4 (or 4/8 and so on). There are no time signature changes. |
| 0,150 | The first field is always 0, this piece is 150 measures long. |
| 1,4 | There is no pickup measure. The piece begins with 4 beats in a time signature (of 4/4, or 4/8 and so on). |
| 12,3 | In measure 12, the time signature changes to 3/4 (or 3/8 and so on). |

An instrumentation data file 409 is preferably created with any standard text processing software and the format of the file typically follows the following conventions:

1. All fields must be entered and there must be a comma between each field. Each instrumentation is on a separate line within the file.
2. If the list is missing channel numbers, the channel will not be played. Any channel to be played must be entered in the file.
3. There must always be an Instrumentation/Transpose Track File for each score. The preferred accompaniment tracks are given below:

Solo track line. The solo track will always appear on the first line in the file and will usually be track 1, or track 0 for pieces in the jazz idiom. The default play status is off so it is not necessary to indicate it here.

Accompaniment line. This track names the type of accompaniment (Orchestral, Continuo, Ensemble, or Concert Band), and indicates the default status to be set in the instrumentation dialog.

Instrumentation tracks line. This track is a list of the MIDI tracks utilized for the accompaniment. Valid entries are typically 1 through 64, inclusive. The tracks do not have to be in order.

Transpose Flag line. This track lists for each track in the immediately previous line, and in the same order, whether or not the track can be transposed. 'T' indicates a transposable staff, 'F' indicates a track that cannot be transposed.

A typical example of a tracks file is given below:

1,Solo

Continuo, on 2,3,4,5

T,T,F,T

Piano, off

6

An IA data file 411 is preferably created with any standard text processing software and the format of the file typically follows the following conventions:

1. All fields must be entered and there must be a comma between each field. Each region is on a separate line within the file.
2. A region is typically not specified by a repeat. A separate file of this type must be specified for each edition supported. A region specified for IA ON preferably consists of the following fields:
   Field 1: Tendency setting (1–5).
   Field 2: Bar number (counted from the beginning of the score) of the starting point of the region.
   Field 3: Beat number of the starting point of the region.
   Field 4: Bar number (counted from the beginning of the score) of the ending point of the region.
   Field 5: Beat number of the ending point of the region.

A typical example of an IA data file is given below:

5,20,1,10,1

2, 5,2,1,4

A user options data file 413 that will be used to set the hardware timing, skip interval, catch-up and quit interval, is preferably created with any standard text processing software and the format of the file typically follows the following conventions:

1. All fields must be entered and there must be a comma between each field.
2. There is typically always a user options default file for each score. A single line specified for user options preferably consists of the following fields:
   Field 1: Hardware timing (anticipation).
   Field 2: Skip interval.
   Field 3: Catch up.
   Field 4: Quit interval (patience).

A typical example of a user options data file is given below:

20,1,200,10

An information text data file such as a composer biography file 415, a composition file 417, a performance file 419, or a terms and symbols file 421 is preferably stored as a standard tagged image format file (TIFF). Carriage returns are used to separate one paragraph from another. Indentation of paragraphs is typically accomplished by using the space bar on the keyboard to insert blank spaces. Typically, any standard graphics creation software may be used to create associated graphics, but the final graphic file is preferably inserted into the text file for which it is intended. Graphics are displayed in a text file such that the graphic takes the position of a paragraph within the text. Text does not typically wrap around the graphic.

Communications Protocols

The communications protocols between the workstation 111 and the hardware module 207 (FIG. 2, FIG. 5) may preferably classified as initial communication, performance communication, other communication, and communication codes as given below:

Initial Communication:

Are We Connected. Whenever a score is loaded from disk, the workstation IA software 109 (FIG. 1) will send the hardware module 207 an electronic message "AreYouThere." The hardware module responds with IAmHere.

Software Dump. After their initial communication, the workstation IA software 109 will download software and data to the hardware module 207 by sending a SoftwareDump. The hardware module 207 responds with SoftwareReceived. This allows for concurrent software upgrades.

Self-Test Diagnostics. Following the software dump, the workstation IA software 109 will send ConductSelfTest, to which the hardware module 207 responds with SelfTestResult. If the test result is anything but TestOK, the workstation 111 displays a dialog box describing the problem, and offering possible solutions.

Performance Communication:

Reset Synth. After a score is loaded from disk, the workstation IA software 109 will send ResetSynth. The hardware module 207 will reset all of the synthesizer's parameters to their defaults, and then respond with SynthReset.

Preset Dump. After a score is loaded from disk, the workstation IA software 109 will have to send custom presets to the hardware module's synthesizer. The workstation 111 will use Emu's standard system-exclusive preset format.

Pitch Recognition Setup. After a score is loaded from disk, the workstation IA software 109 will send ScoreRange, which are the lowest and highest notes scored for the melody. The hardware module 207 responds with ScoreRangeReceived. The hardware module will use this range to set breakpoints for its input filter.

Pitch Follower. Immediately before playing a score, the workstation IA software 109 will send either TurnOnPitchFollower or TurnOffPitchFollower, depending on the workstation's following mode. The hardware module 207 responds with PitchFollowerOn or PitchFollowerOff.

Expected Note List. While a score is playing (and if the workstation is in FollowPerformer mode) the workstation IA software 109 will send ExpectNotes, a list of the next group of melody notes to expect. The hardware module 207 responds with ExpectNotesReceived. This will allow a pitch follower module within the hardware 207 to filter out extraneous notes. Since ExpectNotes is sent continuously during playback, this message and response will determine if the hardware module 207 is still connected and functioning.

Synthesizer Data Stream (Workstation→Hardware Module). The score sequence for the hardware module's synthesizer will be standard MIDI Channel Voice Messages. (NoteOn, NoteOff, Preset, PitchBend, etc.)

Pitch Recognition Data Stream (Hardware Module→Workstation). When the hardware module 207 senses and analyzes a NoteOn or NoteOff, it sends a MIDI Note message informing the workstation of the note value. The NoteOn message is followed by a MIDI ControlChange (controller #96) containing the time in milliseconds it took to analyze the note. For example, if it took the hardware module 12 milliseconds to analyze a Middle C, the following two messages would be sent:

1: 90 60 00 (NoteOn, note#, velocity)

2: B0 60 0C (ControlChange, controller #96, 12 milliseconds)

Other Communication:

Tuning. At the performer's discretion, the workstation IA software 109 will send ListenForTuning. The hardware module 207 responds with ListeningForTuning. While the hardware module is analyzing the note played by the performer, it responds at regular intervals with the MIDI note being played, followed by a PitchBend Message showing the deviation from normal tuning. The typically 14 bits of the PitchBend Message will be divided equally into one tone, allowing for extremely fine tuning resolution. A perfectly played note would have a PitchBend value of 2000 hex. If the performer wishes to actually set the hardware module to this tuning, the workstation will send SetTuning, followed by the new setting for A440. The hardware module 207 responds with TuningSet. If the performer cancels the ListenForTuning while the hardware module is analyzing notes, the workstation IA software 109 will send StopTuning. The hardware module 207 responds with TuningStopped. The workstation IA software 109 may also send the hardware module GetTuning. The hardware module 207 responds with TuningIs, followed by the current deviation from A440.

Reverb Setup. At the performer's discretion, the workstation IA software 109 will send SetReverb followed by the parameters room, decay, and mix, as set in the workstation's reverb dialog box. The hardware module 207 responds with ReverbSet. The workstation IA software 109 may also send the hardware module GetReverb. The hardware module 207 responds with ReverbIs, followed by the current reverb parameters.

Protection. At random times, while a score is playing, the workstation IA software 109 sends ConfirmKeyValue. The hardware module 207 responds with KeyValueIs, followed by the key-value of the protection key. If the key-value does not match the score's key-value, the workstation IA software 109 will stop playing and display a dialog box instructing the performer to insert the proper key into the hardware module 207. If the key value matches, the workstation IA software 109 sends KeyValueConfirmed. The hardware module 207 may also send KeyValueIs at random intervals to protect itself from being accessed by software other than the workstation IA software 109. If the key-value matches the currently loaded score, the workstation IA software 109 responds with KeyValueConfirmed. If the hardware module 207 does not receive this confirmation, it ignores the regular MIDI data until it receives a ConfirmKeyValue from the workstation IA software 109, or a new protection key is inserted. It is possible that a "no protection" protection key be used which disables the key-value messages, allowing the hardware module to be used as a normal MIDI synthesizer. When a new protection key is inserted into the hardware module, the hardware module 207 will send NewKeyValueIs, followed by the new key-value. If this does not match the currently loaded score, the workstation IA software 109 should offer to open the proper score for the performer. If the key value matches, the workstation responds with KeyValueConfirmed.

Communication Codes:

The workstation to hardware module codes have the least significant bit set to zero. Hardware module to the workstation codes have the least significant bit set to one. All values are in hex.

---

General Format
- F0 (Start of System Exclusive Message)
- BOX or the workstation identification byte(s)
- CommunicationCode
- Data byte(s)
- F7 (End of System Exclusive Message)

AreYouThere 10
IAmHere 11
SoftwareDump 12 nn...
SoftwareReceived13
- nn... = BOX's software ConductSelfTest 14
SelfTestResult 15 nn
- nn = result code (00 = TestOK, 01–7F = specific -continued

```
    problems)
ResetSynth          16
SynthReset          17
TurnOnPitchFollower20
PitchFollowerOn21
TurnOffPitchFollower22
PitchFollowerOff23
ScoreRange          24 n1 n2
ScoreRangeReceived25
        n1 = lowest note, n2 = highest note
ExpectNotes         26 nn...
ExpectNotesReceived27
        nn... = note list
ListenForTuning30
ListeningForTuning31
StopTuning          32
TuningStopped       33
SetTuning           34 n1 n2
TuningSet           35
GetTuning           36
TuningIs            37 n1 n2
        n1 n2 = Pitch Bend Message deviation from A440
SetReverb           40 n1 n2 n3
ReverbSet           41
GetReverb           42
ReverbIs            43 n1 n2 n3
        n1 = room, n2 = decay, n3 = mix
ConfirmKeyValue     70
KeyValueIs          71 nn
KeyValueConfirmed72
NewKeyValueIs       73 nn
        nn = key-value
```

Data Structures and File Formats

The data for user options is given below. This is information that the user sets through PM menus. It is broken down as follows:

```
User Options
(1) Following Mode
(1) Type of Countoff
(2) Number of bars to countoff
(2) Input Sound
(2) MIDI Note value for Input Sound
(2) Controller value for Input Sound
(2) Playback Position Indictor update flag
(2) Metronome Sound (Mac or IVL box)
(2) Metronome On/Off
(2) Metronome Accented on First Beat
(2) Metronome Flash Icon for tempo
(2) Metronome Tempo Note (for fixed following,)
(2) Metronome Tempo (beats per minute for fixed following)
(2) Patience
(2) Anticipation
(2) Skip Interval
(2) Catch-Up Rate
(2) Reverb Type (Large Hall, etc.)
(2) Mix
(2) Reverb Time
(2) Transposition Value
(1) End of Chunk marker
File Format (RIFF description)
<VIVA-form>->       RIFF('VIVA'
                    <INFO-list>     //  file INFO
                    <vkey-ck>       //  key(s)
                    <opts-ck>       //  default options
                    <pamp-list>     //  pamphlet data
                    <prst-ck>       //  presets
                    <scdf-ck>       //  score definition
                    <scor-ck>       //  score data (repeats &
                                        marks)
                    <tmpo-ck>       //  default tempo data
                    [<cuts-ck>]     //  default cuts data
                    [<ia-ck>]       //  default IA region data
                    <itrk-list>     //  instrument tracks data
```

-continued

```
                    <user-list>)    //  user data (User saved
                                        file only)
// File Info
<INFO-list>->       LIST('INFO' { <ICOP-ck> |       //  copy-
                                                        right
                    <ICRD-ck>|      //  creation date
                    <INAM-ck>|      //  name of content
                    <iedt-ck>|      //  edition
                    <iver-ck>}±)    //  version
// Keys
<vkey-ck>->         vkey(keystring:BSTR)
// Protection key(s)
// Pamphlet Data
<pamp-list>->       LIST('pamp' { <pbio-ck> |
// composer's biographical info
                    <pcmp-ck>|      //  composition info
                    <ptrm-ck>|      //  terms
                    <phnt-ck>}±)    //  performance hints
// Default Options
<opts-ck>->         opts( <options:OPTIONS>)
// Options struct
// Presets
<prst-ck>->         prst( <prst-data>)
// MIDI sysex data
// Score Definition
<scdf-ck>->         scdf( <DeltaDivision:s16bit>
// ticks per beat
    <StartMeasure:u16bit>           //  beginning measure
    <NumberOfMeasures:u16bit>)      //  number of measures
// Score Map
<scor-ck>->         scor( {<delta time:varlen>
<event:score_event_type> }± ) // event list
// Tempo Map
<tmpo-ck>->         tmpo( {<delta_time:varlen>
<event:tempo_event_type> }± ) // event list
// Cuts Map
<cuts-ck>->         cuts( {<from_delta_time:varlen>
<to_delta_time:varlen> }± )
// event list
// Intelligent Accompaniment Map
<ia-ck>             ->      ia( {<delta_time:varlen>
<tendency:u8bit> }± )           //  event list
//Instrumentation Track(s)
<itrk-list>->       LIST('itrk' { <solo-ck> |
// Soloist track
                <inst-ck> }± )
// Instrument track
// User Saved Options
<user-list>->       user( {<opts-ck> |
// Menu & Dialog Options
                <tmpo-ck> |     //  User Tempo Map
                <cuts-ck> |     //  User Cuts Map
                <ia-ck> }± )    //  User IA Map
// Options struct
<OPTIONS>->         struct {
                            <UseOptions:u8bit>
// "Use" checkboxes: >IA, Cuts, Repeats, Metronome, Msg
Bar>                        <CountoffOption:u8bit>
// <Soloist, 1 Bar, 2 Bar, with or w/o Click>
                            <FromPosition:u32bit>
// Play From position
                            <ToPosition:u32bit>
// Play To position
                            <SelectIA:u8bit>
// IA Following: <Soloist, Tempo %, Strict Tempo>
                            <PlayAtTempoPct:ul6bit>
// Tempo % EditBox value
                            <PauseBars:u8bit>
// Pause for n Bars EditBox value
                            <PlayAtBPM:ul6bit>
// Beats per Minute EditBox value
                            <Transpose:s8bit>
// Transpose value
                            <ReverbType:u8bit>
// <None, Sm Room, Lg Room, Sm Hall, Lg Hall, Taj Mahal>
                            <ReverbDecay:u8bit>
// Reverb Decay value
                            <ReverbMix:u8bit>
// Reverb Mix (Dry to Wet) value
```

-continued

```
                                <Anticipation:u16bit>
// Playback Anticipation value.
                                <SkipInterval:u16bit>
//Interval threshold for accomp to skip ahead
                                <Acceleration:u16bit>
// Rate for accomp to race ahead
                                <Patience:ul6bit>
// Patience value
                }
// Soloist track
<solo-ck>->             solo( <thdr-ck> <MTrk-ck>)
// solo track (header followed by MIDI data)
// Instrument track
<inst-ck>->             inst( <thdr-ck> <MTrk-ck>)
// instrument track (header followed by MIDI data)
// Track header
<thdr-ck>->             thdr( <Flags:u16bit>
// Track Flags: Transposable, Play Default
                                                <Name:BSTR>
// Name of the Instrument/Group
```

Match Algorithm

The algorithm for matching an incoming note of the soloist performance with a note of the performance score is given below:

```
definitions:
    interval is specified as a minimum difference for
    determining tempo, embellishments, missed notes,
    skipped notes, etc. (eg. interval = 1 measure)
    skipinterval is the threshold that a wrong note is not
    matched with the expected event. (eg.
    (MaxTempoDeviation * BPM * TPB) / 60)
if (Paused)
    search for event
    if (found) set expected event.
if (eventnote == expectednote)          //  note is expected
{
    if ((expectedtime - eventtime) > interval)      //  more than 1
                                                    //  interval
    {
        if (eventtime < (lasttime + lastduration))      //  check
                                        //  for possible embellishment
            skip current event.
        else
            jump to expected event.
            set last matched event.     //
            clear tempo average.        //  used for tempo
                                        //  calculations
    }
    else                                //  within interval
    {
        if ( last matched event )
            compute tempo from eventtime && expectedtime &&
                last matched event.
            average into tempo average.
            increase tempo average items.
        else
            clear tempo average.        //  used for tempo
                                        //  calculations
        jump to expected event.
        set last matched event.                 //
    }
}
else                                    //  note isn't expected.
{
    if (eventtime < (lasttime + lastduration))      //  check for
                                        //  possible embellishment
        skip current event.
    else
    {
        if ((expectedtime – eventtime) <= skipinterval)
                                //  less than skipinterval (wrong note)
        {
            jump to expected event.
            set last matched event.
        }
        else
        {
            search for current event in expectedtime +–
                interval.
            if ( found )            //  event in this interval.
            {
                if ((foundtime – eventtime) <= skipinterval)
                                //  less than skipinterval (skipped)
                {
                    if ( last matched event )
                        compute tempo from eventtime &&
                            expectedtime.
                        average into tempo average.
                        increase tempo average items.
                    else
                        clear tempo average.    //  used for
                                                    tempo
                                                //  calculations
                    jump to expected event.
                    set pausetime to currenttime + patience.
                    set last matched event.
                }
                else
                    skip current event      //  probably not a skip.
            }
            else
                skip current event
            }
    }
}
if (tempo average items > set tempo threshold)
    set new tempo.
set expected event to next eventtime > currenttime.
if lasttime > Patience
    Pause.
    clear lastevent.
```

File Markers

Markers are MIDI events that provide the system with information about the structure and execution of a piece. These events are of the MIDI type Marker and are stored in "Track 0" of a standard MIDI file.

Each marker contains a text string. Markers typically do not contain any spaces. There are several types of markers required in every sequence file:

1. EOF Marker.
2. IA Region Defaults.
3. Musical Pause Markers (fermatas, etc.).
4. Tempo Reset Markers.
5. Open and Close Window Markers.
6. Optional Octave Markers.
7. Rehearsal Markers.
8. Repeat Markers (including D.C. and D.S.).

Markers are typically placed in the sequence at the precise measure, beat and tick that each of the following events actually occurs. For events that occur on the barline, this will typically correspond to beat 1, tick 0 of the measure that begins on that barline.

There is an exception to the above rule in the case of repeat markers that occur before the first barline (in measure "zero"). If a piece contains such a repeat, then all repeats for that sequence are placed ON the barline immediately following their location in the score.

1. EOF. The location in the sequence corresponding to the final double bar in the printed score is marked with an End Of File (EOF) marker. It is simply a marker event with the text "EOF" (no quotes).

If the score ends with a full measure, the EOF marker is usually placed on beat 1, tick 0 of the measure AFTER the last measure of sequenced notes. This corresponds to the precise location of the double bar signaling the end of the piece.

If the score ends with a partial measure, the EOF marker is typically placed at the precise location of the double bar within that measure.

2. IA Regions ON/OFF Defaults. Intelligent Accompaniment (IA) may be set to any integer value from 0 to 100. A marker with the text "IA=x" placed in a sequence will set the value of IA to the number "x" at that location.

Every repertoire sequence will typically be shipped with default IA regions. Default regions may be set to one of the following values:

IA=0 represents "IA is OFF" or "Soloist follows Accompaniment".

IA=20 represents "weaker" following.

IA=50 represents "moderate" following.

IA=80 represents "stronger" following or "Accompaniment follows Soloist".

Each sequence typically has an initial default IA setting at measure 1, beat 1, tick 0.

3. Musical Pauses. Musical pauses include fermatas (over notes, rest or cadenzas), tenutos, commas, hash marks and some double bars. If there is an option for the soloist to pause or hold a note before continuing in tempo, a Pause Marker is typically inserted into the file. Musical Pauses occurring in the middle of a section where the accompaniment is playing entirely by itself typically do not need to be marked with Pause markers.

Pause markers come in pairs: a pause start and a pause end. When the system comes to a pause start marker, all MIDI events freeze. All accompaniment notes that are currently playing will hold. When the signal to continue is received, the system jumps immediately to the pause end marker and resumes playback. Any MIDI events that occur in the sequence between the pause start and end markers will be played "simultaneously" when playback resumes. For this reason all audible MIDI events are typically eliminated from the pause region. An exception to this rule is soloist cadenza notes, which are only audible when the user is listening rather than playing along.

Precise placement of the markers is important for the following reasons:

If accompaniment notes are to be held, the pause start must be placed after all of the "holding notes" have started playing.

If the accompaniment notes should cut off before the end of the pause (as in a typical cadenza), the pause start must be placed after all of the accompaniment notes have ended.

If notes should cut off at the end of the pause, the pause end must be placed immediately before the end of the notes (the note off messages).

If the soloist has more than one note to play over a held accompaniment note, the pause start must be placed after the last soloist note has started.

The pause start should typically be placed as early as possible. This means placing it immediately after the last event that is to occur before the pause starts.

There are three types of pauses. The difference between them is the type of event which signals the system to continue the sequence. The pause start marker denotes the pause type:

| Pause Marker | Continue on | Description |
|---|---|---|
| PS,S | Note ON event | Sequence will continue when the soloist plays the first solo note located after the pause start marker. |
| PS,N | Note OFF event | Sequence will continue when the soloist finishes playing the single held note. |
| PS,F | Footswitch event | Sequence will continue when the soloist taps the foot pedal. |

The pause end marker is typically represented as "PE" (no quotes). There is almost always a Tempo Reset marker at the pause end.

The PS,S or PS,N type pauses are typically used whenever possible rather than the PS,F. This eliminates the need for the soloist to worry about the footswitch. Also, the system will continue with a Footswitch event for any of the three pause types if the soloist chooses to tap the foot pedal.

PS,F is typically required for all cadenzas. PS,F is also required anywhere where the soloist is unable to distinctly signal the system to continue with a MIDI note ON or OFF event.

A PS,N is often needed on the last note of a piece, even if a printed fermata is not present. This is the case when the piece slows down to a final held note that may be played for an indeterminate amount of time, depending on the soloist.

Two pause marker pairs may be required where there is a held note followed by a "break" or silent pause (notated as slash marks). This is treated like two fermatas, one over a note and one over a rest. The first pause (typically PS,N) will hold until the soloist ends the fermata note. The second pause will start immediately following the end of the first. This pause may either wait for the soloist's next note (PS,S) or a footswitch signaling the accompaniment to start playing alone (PS,F).

4. Tempo Reset. These markers are used to force the system to reset itself to the current tempo recorded in the sequence tempo map or any edited tempos as specified by the user. This marker typically causes a reset whether IA is ON or OFF. The text for this marker is preferably "TR" (no quotes).

Tempo reset markers are typically placed in locations in the sequence where there is an abrupt printed tempo change. For example:

"A tempo" markings after a ritard.

Tempo changes that are labeled at the beginning of a new section of music.

Immediately after Musical Pause markers.

Tempo Reset markers are usually needed after fermatas and other pauses, to reset the system to a "playing" rather than "holding" tempo setting. A Tempo Reset marker is not needed at the opening measure of a piece, because one is always "assumed" to set the opening tempo. Tempo Resets are not needed at meter changes where the basic beat or pulse continues at the same tempo. For example, in a transition from 2/4 to 6/8 where there is a tempo marking indicating that a quarter note in the 2/4 measure is equivalent to a dotted quarter in 6/8, the pulse continues at the same speed. No Tempo Reset is needed.

5. Open and Close Windows. These markers are used to denote sections of music where the accompaniment is holding notes or resting during rhythmic beats that the soloist is playing alone. These regions are referred to as "window regions". The markers instruct the system to "listen" and "follow" more closely than usual in these window regions, so that when the accompaniment comes back in, it enters precisely with the soloist.

These areas are different than soloist cadenzas. A cadenza is not divided into regular measures, nor does it play through without extreme tempo changes. Cadenzas are instead typically marked with a set of Pause Markers.

All window regions usually require Open and Close Window markers. The window regions are defined as follows:

Within a window region, the soloist is playing while the accompaniment is holding a single chord or resting. There are no accompaniment "note ON" events within a window region.

A window region typically must be notated in regular measures, without extreme tempo changes or fermatas. This is typically when the window is not a cadenza.

The length of a window region is usually determined by counting the number of beats of empty space between accompaniment "note ON" events.

The length of the window region typically must be at least the number of beats defined by one of the following:

For steady passages:

$$\text{beats} = \frac{\text{tempo (beats per minute)}}{20}$$

For rubato passages:

$$\text{beats} = \frac{\text{tempo (bpm)}}{30}$$

For example, if the tempo in a steady Adagio 4/4 section was quarter note=80 bpm, the shortest window region would preferably be at least 80/20 or 4 beats long. If there was a passage where the accompaniment was holding a whole note chord, while the soloist was playing quarter notes in tempo, this typically would qualify as a window region.

The markers preferably have the following format:

OW=Open window (start "following" very closely).

CW=Close window (resume normal "following").

The placement of these markers is preferably at the location of the "note ON" of the accompaniment notes that define the beginning and end of the region.

If there are two window regions that occur one immediately after the other, separated by a single accompaniment note or chord, they may be marked together as a single window region, with a single pair of Window markers such as an OW at the beginning of the first region, and a CW at the end of the second region.

6. Optional Octave. These markers are used where the music indicates that the soloist may optionally play at a higher or lower octave. They are preferably of the following format:

OS=Octave option region Start.

OS,Un=Octave option region Start, option of playing up n octaves.

OS,Dn=Octave option region Start, option of playing down n octaves.

For example, the marker "OS,D1" would indicate that the soloist has the option of playing one octave below the sequenced notes after the marker. This marker should preferably be placed at least one tick before the beginning of the optional octave section.

If more than one octave is allowed, two OS marker events may be placed in the sequence. For example, if the soloist is allowed to play up one octave or down one octave, two marker events would be inserted: "OS,U1" and "OS,D1".

OE=Octave option region End.

This marker cancels all optional octave settings and returns the system to normal tracking. It should preferably be placed at least one tick after the end of the optional octave section.

7. Rehearsal Marks. Rehearsal Marks are letters, numbers or text which appear in the sheet music to assist the soloist in locating a particular passage. Each Rehearsal Mark appearing in the soloist's music may be included in the sequence file using a MIDI Marker event.

Text such as sectional labels and tempo descriptions may be included if they are logical rehearsal points. For example, the text "Presto" should preferably be included as a rehearsal mark if it marks the beginning of a section that the user would likely wish to locate for practice or looping. Likewise, the text "Var. I", or "Coda", etc. would also be helpful to the user.

The only rehearsal marks which typically are not included as MIDI marker events are printed measure numbers that meet both of the following conditions:

1. They correspond exactly with the measure numbering rules used by the system interface.
2. They are not specifically located at logical rehearsal points.

For example, measure numbers printed every 10 measures, or at the first measure in each line of music would typically not be considered rehearsal marks. Measure numbers which match the system interface rules but are printed at logical rehearsal points typically would be considered rehearsal marks. If there is doubt, preferably the measure numbers will be included.

The system interface measure numbers are usually determined by labeling the first full printed measure as measure 1, and continuing sequentially right-to-left, top-to-bottom, page to page, ignoring all repeats, D.C.s, etc. until the last printed measure is reached.

Each Rehearsal Mark event preferably has the format "RM/ ". The text of the printed rehearsal mark is included after the "/". The placement of this marker is typically at tick 0 of the sequence measure corresponding to the location of the rehearsal mark in the music. This may be in the middle of a measure.

If the printed measure with a rehearsal mark is played more than once during the piece (repeated sections, D.C.'s, etc.), a marker is usually only required for the first occurrence in the sequence. Duplicate markers are redundant but not harmful.

Extra spaces preferably must be avoided in Rehearsal Mark events, especially after the "/".

8. Repeat Markers. Repeat Markers are MIDI events that provide the system with information about the structure of a piece. Repeat Markers include markers for repeated sections, multiple endings, as well as Da Capo, Del Segno and Coda sections.

Repeat Markers should typically be placed in the sequence at the location of the event in the score. For events that occur on the barline, this corresponds to beat 1, tick 0 of the measure that begins on that barline. If a Repeat Marker occurs in the middle of a measure, it is typically placed in the middle of the corresponding sequence measure. An exception to this rule occurs in pieces which have a repeat printed before the first full measure. All mid-measure repeats in such a piece typically must be shifted later to the nearest barline.

For example, a Repeat Marker which occurs just before a pickup note to the first full measure of a piece indicates the exception must be followed. This repeat is treated as if it were ON the bar line of the first full measure. All other mid-measure repeat markers in this piece typically must be moved to the nearest barline as well.

Almost all Repeat Markers contain a number (m) indicating the measure number of the event location in the printed score. The printed measure numbers are typically determined by labeling the first full printed measure as measure 1, and continuing sequentially right-to-left, top-to-bottom, ignoring all repeats, D.C.s, etc. until the last printed measure is reached. If there are pickup notes before the first full measure, these occur in printed measure 0. Printed measure 1 always corresponds to sequence measure 2.

The printed measure number (m) for an event can be found as follows:

If a printed event occurs on a bar line, use the measure number of the measure which begins at that bar line.

If a printed event occurs in the middle of a measure, it is treated as if it occurred on the immediately preceding bar line. The measure number is typically used immediately preceeding bar line.

Some examples:

A closing repeat sign on the barline at the beginning of measure 7→m=7.

A closing repeat sign in the middle of measure 7→m=7.

A closing repeat sign on the barline at the end of measure 7→m=8.

It is especially important to make sure the measure number of markers which end a section correspond to the first printed measure or partial measure which is played after that section has ended. A repeat that occurs before the first full measure of a piece indicates that the exception is followed, and all mid-measure repeats for that piece are moved later to the nearest barline.

Repeats

The beginning of each iteration of each repeat should typically be marked as follows:

Rr,t,m where r preferably equals the repeat number starting with 1 on the first printed repeat pair and increasing by 1 for each successive pair, and t preferably equals the time through repeat, 1 for first iteration, 2 for second, etc. If the value of t equals 0, it denotes the only iteration of a repeat, which often occurs in a DC section where repeats that were previously taken are ignored (as per musical convention).

The value m equals the measure number of location in printed score. For example, the marker 40-1: R,2,12 marks the location in the sequence of the third printed repeat, beginning at the second iteration. This occurs at the beginning of measure 12 in the printed score, and at measure 40, beat 1 in the sequence.

For repeat markers within D.C. or D.S. sections, the value of t resets to 1 as the whole repeated section is entered a second time.

Repeat Endings

The end marker for a repeated section without multiple endings preferably is represented as:

Rr,E,m where r equals the repeat number and m equals the measure number of location in printed score. If there are multiple endings, they typically must each begin with the following marker:

Er,m where r equals the repeat number and m equals the measure number of location in printed score. If there are multiple endings, there typically must be an additional marker at the very end of the last ending, to signal the end of the entire repeated section:

Rr,E,m where r equals the repeat number and m equals the measure number of location in printed score. For example, 101-1: E,53 marks the location in the sequence of an ending for repeat 4. This occurs at the beginning of measure 53 in the printed score, and at measure 101, beat 1 in the sequence. Another example:

44-1: R3,E,16 marks the location in the sequence of the end of repeat 3. This repeat does not have multiple endings. This occurs at the beginning of measure 16 in the printed score, and at measure 44, beat 1 in the sequence.

It is especially important to insure the measure number of markers which end a section correspond to the first printed location which is played after that section has ended. The printed measure number (m) corresponds to the first printed measure or partial measure played after the repeat is over. Likewise, the location of the repeat end marker typically will be the first tick of the section immediately following the repeated section. If the repeat occurs on a bar line, this means that the end marker will be on beat 1, tick 0 of the measure following the repeated section.

Dal Segnos

Dal Segno markers are preferably labeled as follows:

DSd,f,m where d equals the Dal Segno number, starting with 1 for the first Dal Segno and increasing sequentially for multiple Dal Segnos; f equals the flag to denote whether this marks the location of the printed symbol going by the first time (f=1), the actual beginning of the sequenced DS section (f=2), or the end of the DS section (f=E); m equals the measure number of location in printed score.

If there is music after the D.S. (e.g. the Coda in a D.S. al Coda), the measure number of the DS end marker (m) should typically be the first printed measure number of the continuing section of music (e.g. the Coda). If there is no music after the D.S. (e.g. D.S. al Fine), then the measure number (m) should be the location of the Fine marking. Similar to the Repeat End marker, if the Fine is on a barline, the measure number (m) will usually be from the printed measure which begins at the Fine.

Da Capos

Da Capos are handled in much the same way as Dal Segnos:

DCd,f,m where d equals the Da Capo number (starting with 1, for the first Da Capo and increasing sequentially for multiple Da Capos; f equals the flag to denote whether this marks the location of the beginning of the whole sequence (f=1), the sequenced D.C. section (f=2), or the end of the D.C. (f=E); m equals the measure number of location in printed score.

Simultaneous Repeat, D. C. or D. S. Markers

Simultaneous markers occur when a repeated section begins or ends at the same time as another repeated, D. C. or D. S. section. This typically requires the creation of a both a repeat marker and a D. C. or D. S. (or additional repeat) marker on the same "tick" in a sequence. Even though these markers share the same location in time, they usually must be separate MIDI marker events. They typically must appear as two events in a sequencer's marker event list. The markers which share the same "tick" typically must appear in a certain order. The general rule is: Markers for each repeated section must be grouped together within the list. In other words, each repeat marker is arranged in the list so that it appears as close to its counterparts as possible. For example, a piece containing the following repeats:

| | | | | | | |
|---|---|---|---|---|---|---|
| | | Fine | | | D.C. al Fine | |
| [: | A | :] [: | B | :] | C | ] |

Produces the sequence:

| | | | | | | | | | | |
|---|---|---|---|---|---|---|---|---|---|---|
| [: | A | :] | [: | A | :] | [: | B | :] | [: | B :] |
| | | | | C | \| | A | \| | B \| | | |

Containing the following equivalent markers:

| | | |
|---|---|---|
| 2-1 | DC1,1,1 | |
| 2-1 | R1,1,1 | first repeat - three repeat markers |
| 4-1 | R1,2,1 | are grouped together, the first |
| 6-1 | R1,E,3 | repeat appears after the D. C. marker |
| 6-1 | R2,1,3 | second repeat - the second repeat begin |
| 8-1 | R2,2,3 | marker appears after the first repeat |
| 10-1 | R2,E,5 | end marker (to group the second |
| 13-1 | DC1,2,1 | repeat markers together) |
| 13-1 | R1,0,1 | first repeat again - appears after D. C. |
| 15-1 | R1,E,3 | marker |
| 15-1 | R2,0,3 | |
| 17-1 | R2,E,5 | second repeat end - appears before the |
| 17-1 | DC1,E,5 | D. C. end marker |

The repeated sections are marked on the D. C., even though the repeats are not played. The "0" (zero) signifies that this is the only time through the section surrounded by printed repeats.

A piece containing the following repeats and endings, etc:

| | | | | | | | | |
|---|---|---|---|---|---|---|---|---|
| | 1,2.-------- | | | 3.---------- | | 4.---------- | | |
| [: | A | \| | B | :] | C | :] | D | E] |

Produces the sequence:

| | | | | | | | | |
|---|---|---|---|---|---|---|---|---|
| [:A | B :] | [:A | B:] | [:A | C | :][:A | D | E ] |

And the markers:

| | |
|---|---|
| 2-1 | R1,1,1 |
| 4-1 | E1,3 |
| 5-1 | R1,2,1 |
| 7-1 | E1,3 |
| 8-1 | R1,3,1 |
| 10-1 | E1,4 |
| 13-1 | R1,4,1 |
| 15-1 | E1,7 |
| 17-1 | R1,E,9 |

The following piece containing the following repeats taken during a D.C. section:

| | | | | | |
|---|---|---|---|---|---|
| | | Fine | | D.C. al Fine (with repeats) | |
| [: | A | :] | B | ] | |

Produces the sequence:

| | | | | | | | | | | | |
|---|---|---|---|---|---|---|---|---|---|---|---|
| [: | A | :] | [: | A | :] | B | [: | A | :] | | |
| | | | | [: | A | :] | | | | | |

Containing the following equivalent markers:

| | | |
|---|---|---|
| 2-1 | DC1,1,1 | |
| 2-1 | R1,1,1 | |
| 4-1 | R1,2,1 | |
| 6-1 | R1,E,3 | |
| 8-1 | DC1,2,1 | |
| 8-1 | R1,1,1 | *Note the value for t = 1. |
| 10-1 | R1,2,1 | *Note the value for t = 2. |
| 12-1 | R1,E,3 | |
| 12-1 | DC1,E,3 | |

The second number in the marker is preferably the variable "t", which is the time through this particular repeat (1=first, 2=second, etc.). This value starts over again at 1 when repeats are taken in a D. C. section.

New Screen Displays

Figure 36:
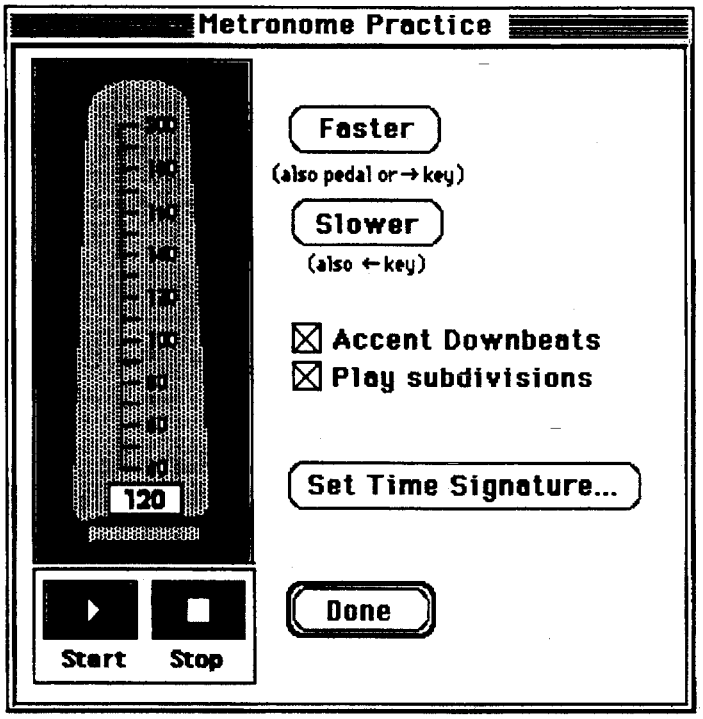
FIG. 36 is a screen display of a metronome practice window according to the present invention.

FIG. 36 shows a preferred metronome practice window as displayed to the user. This feature instructs the accompaniment system to produce a simple metronome click in time with the performance score as a traditional aid to musicians.

A user may preferably select to accent downbeat, play subdivisions, or both. If accent downbeat is selected, the system preferably produces a click in time with the downbeat (first beat) of each measure. The default time signature is 4/4 time. If play subdivisions is selected, then the system provides a unique click in time with the beat subdivisions of each measure. If the performance score is in simple time, the system produces a click every one eighth on "and" of each beat with distinct pitch. If the performance score is in compound time, two triplet eighths are produced with a same distinct pitch. If the score is in composite time, clicks on eighths are typically produced one or two per beat as appropriate.

Figure 38:
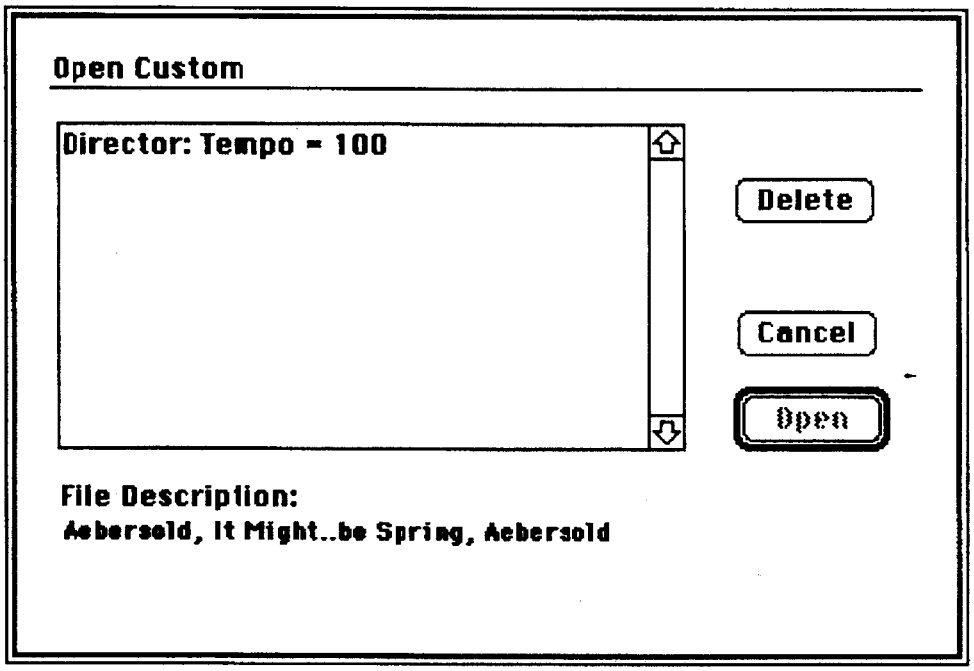
FIG. 38 is a screen display of an open custom settings window according to the present invention.
Figure 42:
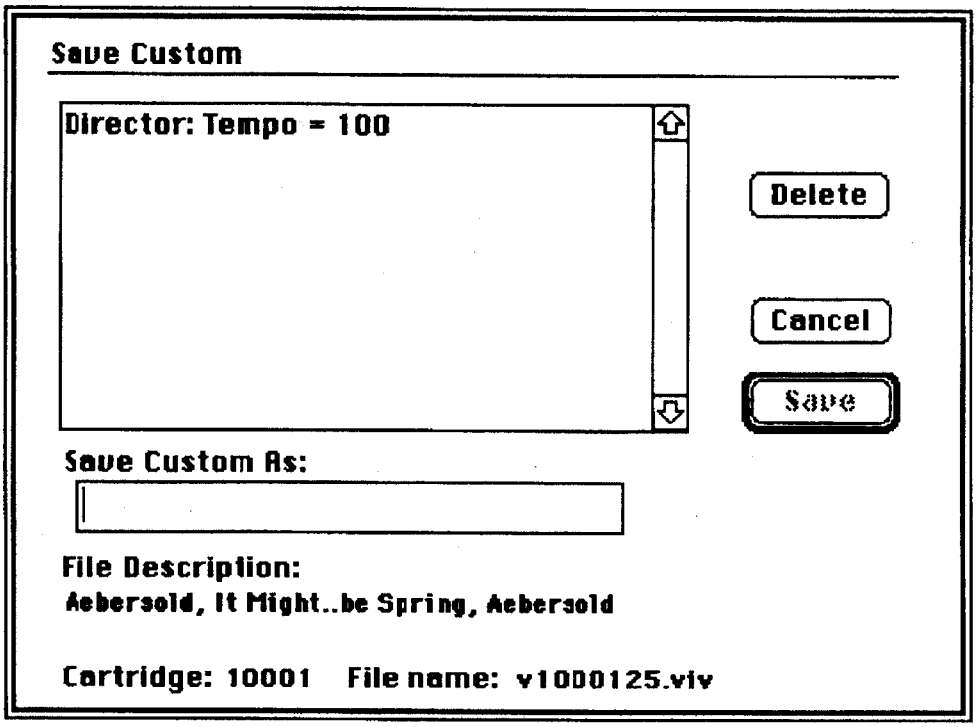
FIG. 42 is a screen display of a save custom file window according to the present invention.

FIG. 38 and FIG. 42 illustrate preferred open and save custom file settings windows as displayed to the user. This feature allows individual soloists to save their performance preferences for a specific music piece. The preferences data file typically contains a soloist data segment containing an identifier for a soloist and an information data segment containing preferred soloist performance settings. The soloist preferences in the information data segment are matched to the soloist identifier for later retrieval. There is usually only one preferences file for any specific musical performance file. The preferences file contains the preferences for all soloists who wish to rehearse that music piece.

A soloist may set his or her preference for performance settings which include practice loops, countoff settings, metronome click status, cuts, reverb, transposition, tempo markings, intelligent accompaniment (IA) markings, instrumentation, repeats, and fine adjustments. It will be recognized that other performance preferences may be stored in a preferences file without loss of generality.

Figure 37:
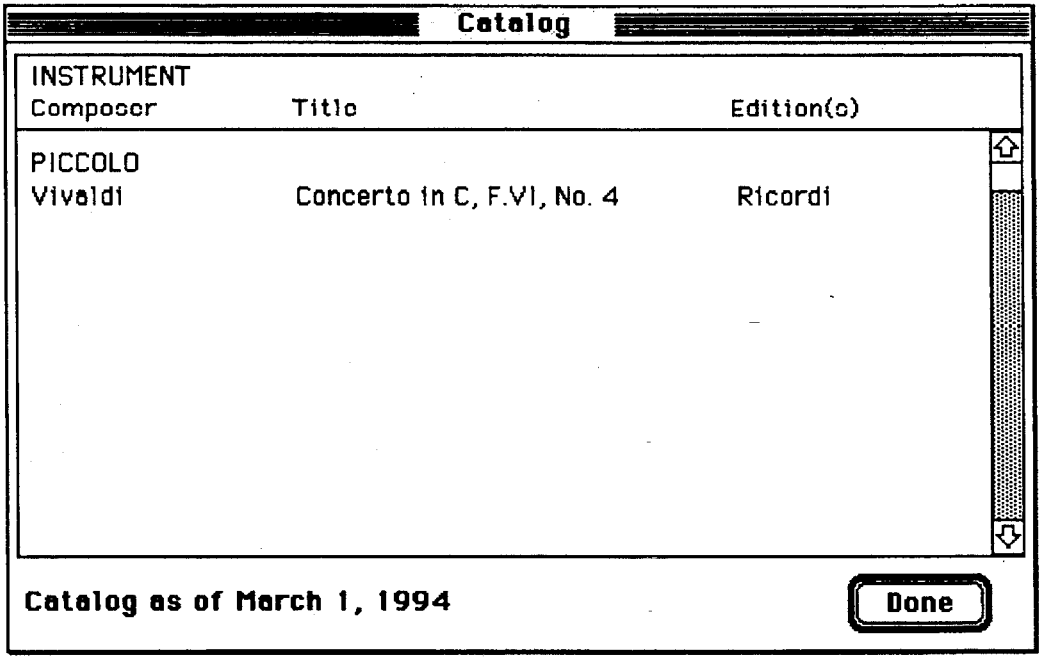
FIG. 37 is a screen display of a catalog window according to the present invention.
Figure 39:
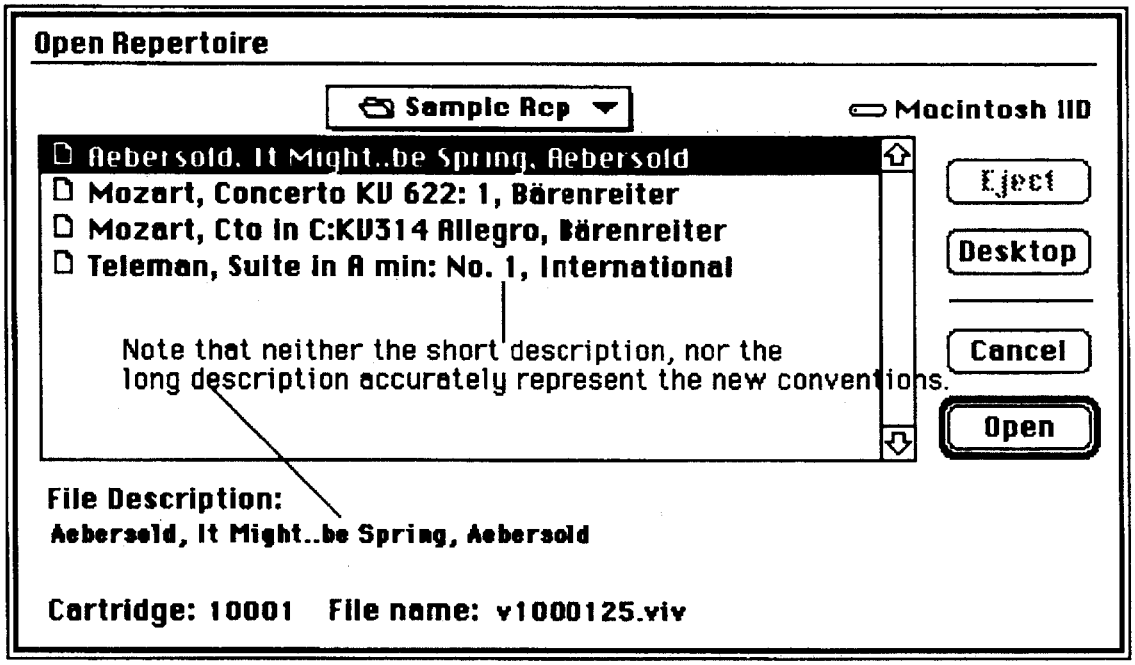
FIG. 39 is a screen display of an open repertoire file window according to the present invention.
Figure 53:
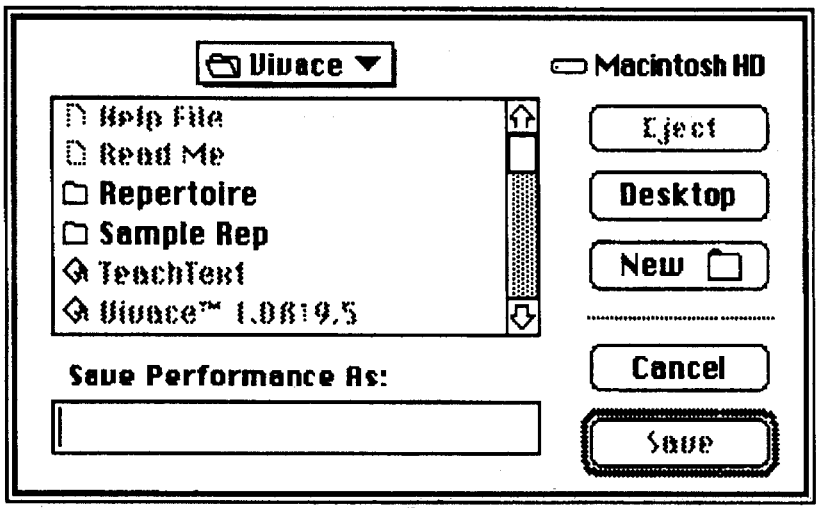
FIG. 53 is a screen display of repertoire save window according to the present invention.

FIG. 39 and FIG. 53 describe preferred open and save repertoire file windows as displayed to the user. This allows a soloist to select a music piece to rehearse or play. A catalog of music pieces is displayed as shown in FIG. 37. This feature preferably reads a text file shipped with the application called Catalog, which contains a listing of the available titles for the system. The Catalog file is typically installed by the application installer, and is shipped with every music piece of repertoire. The application installer typically compares the date of an existing catalog file with the date of the new catalog file to be installed, and updates or replaces the existing file if it is older than the new catalog file.

Figure 43:
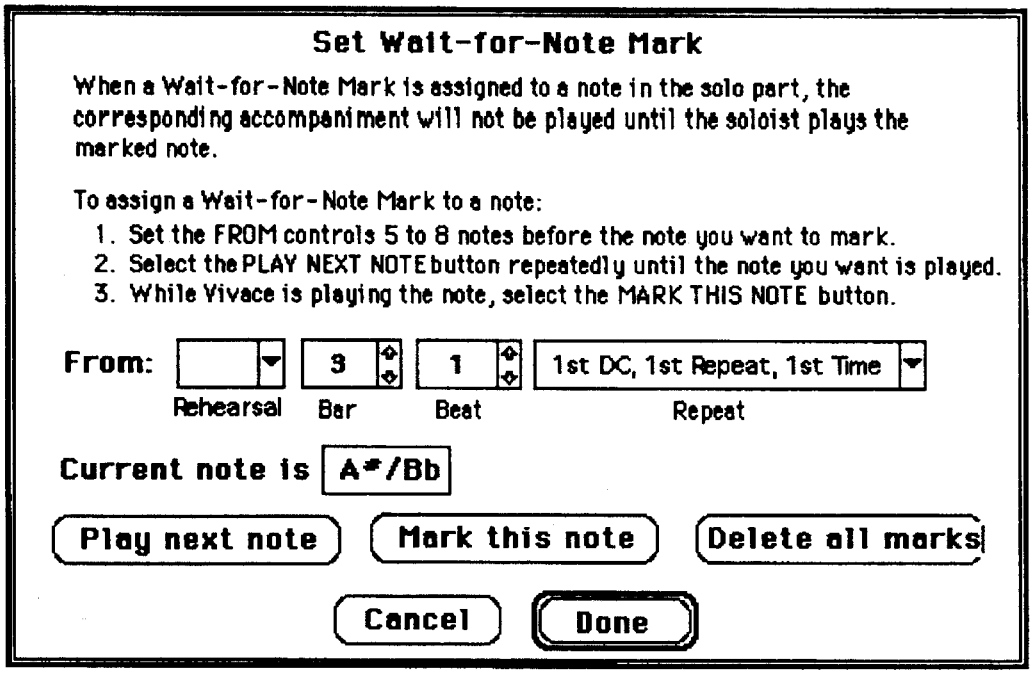
FIG. 43 is a screen display of a set wait window according to the present invention.
Figure 54:
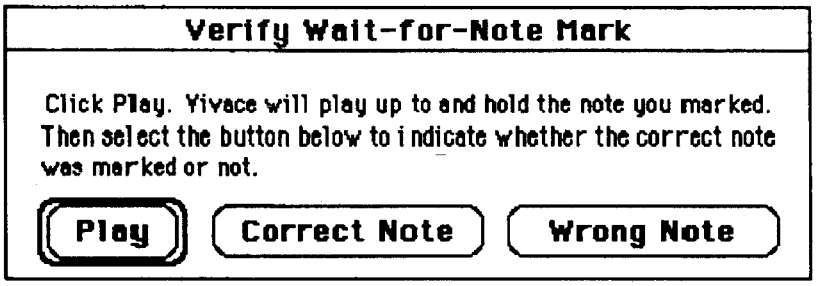
FIG. 54 is a screen display of verify wait window according to the present invention.

FIG. 43 and FIG. 54 illustrate preferred set wait-for-note mark and verify wait-for-note mark windows as displayed to the user. This feature allows a soloist to place a wait-for-note mark in the solo track of the performance score. Placing a wait-for-note mark instructs the system to not play the accompaniment until the soloist plays the marked note.

While the soloist is marking a note, the system plays only the solo part one note at a time. When the soloist selects PLAY NEXT NOTE, the next note is sustained until the soloist selects PLAY NEXT NOTE again. The CURRENT NOTE IS box remains empty until the play next note button is selected. Pitches are shown in transposed spellings to match the solo instrument. This typically requires the labeling of a repertoire file by instrument with a transposition table to set the display of the instrument pitch. Both enharmonic spellings are typically given with no octave designation. When the MARK THIS NOTE button is selected, the current note is no longer played, the verify dialog box shown in FIG. 54 is displayed to the soloist, and solo part is played again from the previously designated start point. When the marked note is reached, it is sustained, and is only terminated when Correct Note or Wrong Note is selected. If Correct Note is selected, the note is permanently marked. If Wrong Note is selected, the note is not marked and the soloist is allowed to repeat the marking procedure.

Figure 52:
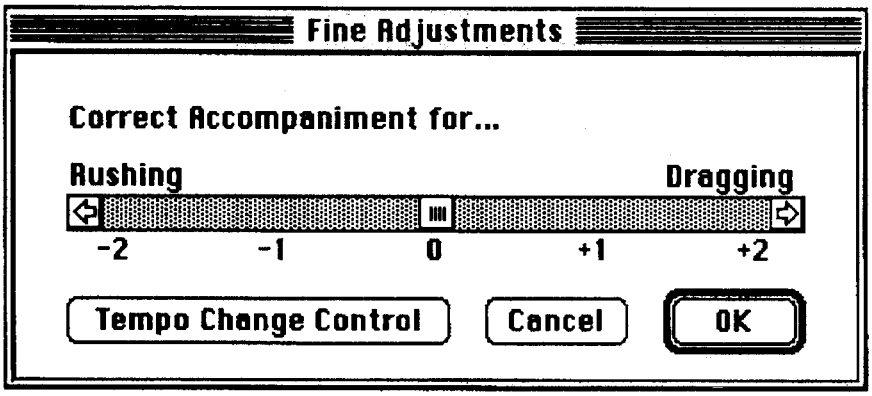
FIG. 52 is a screen display of fine adjustments window according to the present invention.

FIG. 52 shows a preferred fine adjustment window as displayed to the user. This feature allows a soloist to correct the timing of the accompaniment to adjust for rushing or dragging. This is preferably implemented by increasing or decreasing the number of notes in an anticipation window. The anticipation window is the number of notes the accompaniment is playing ahead of the last note the soloist played and may be used to correct for rushing or dragging of the accompaniment as well as processing delays in the system.

Figure 40:
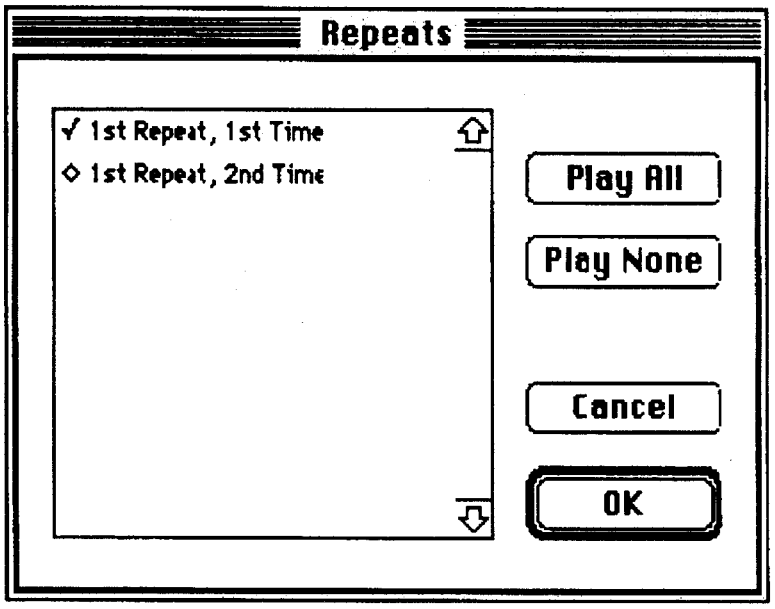
FIG. 40 is a screen display of a play repeats window according to the present invention.

FIG. 40 shows a preferred repeats window as displayed to the user. This feature allows a soloist to customize the performance accompaniment when repeats may be taken within the music piece. When Play Repeats in the Options Menu (FIG. 35) is selected, the system plays repeats as they have been set up by the soloist. When Play Repeats in the Options Menu is not selected, the system takes the last endings on all repeats.

Figure 41:
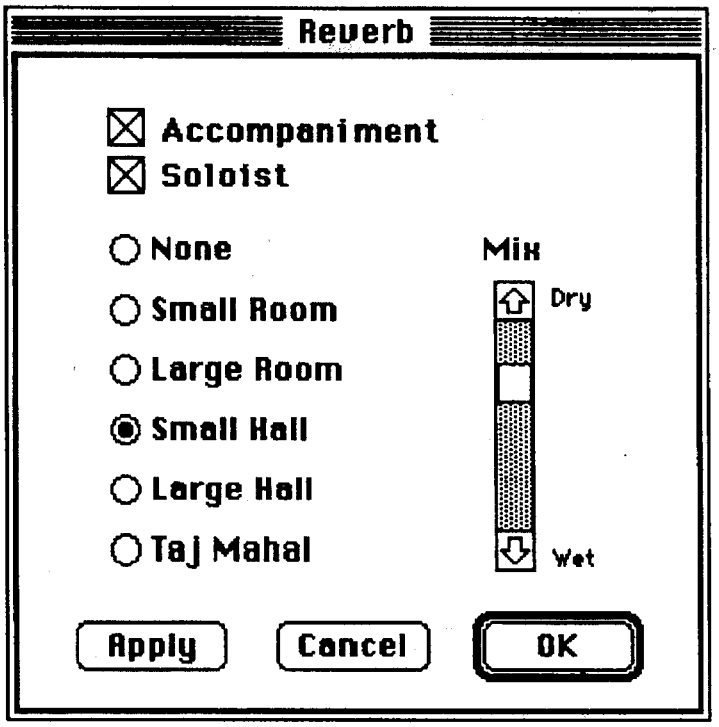
FIG. 41 is a screen display of an accompaniment and soloist reverb window according to the present invention.

FIG. 41 shows a preferred reverb window as displayed to the user. This feature allows a soloist to add reverberation to either the accompaniment or soloist tracks, or both. A preferred hardware balance control allows control of the soloist output through the speakers, with and without reverb applied.

Figure 44:
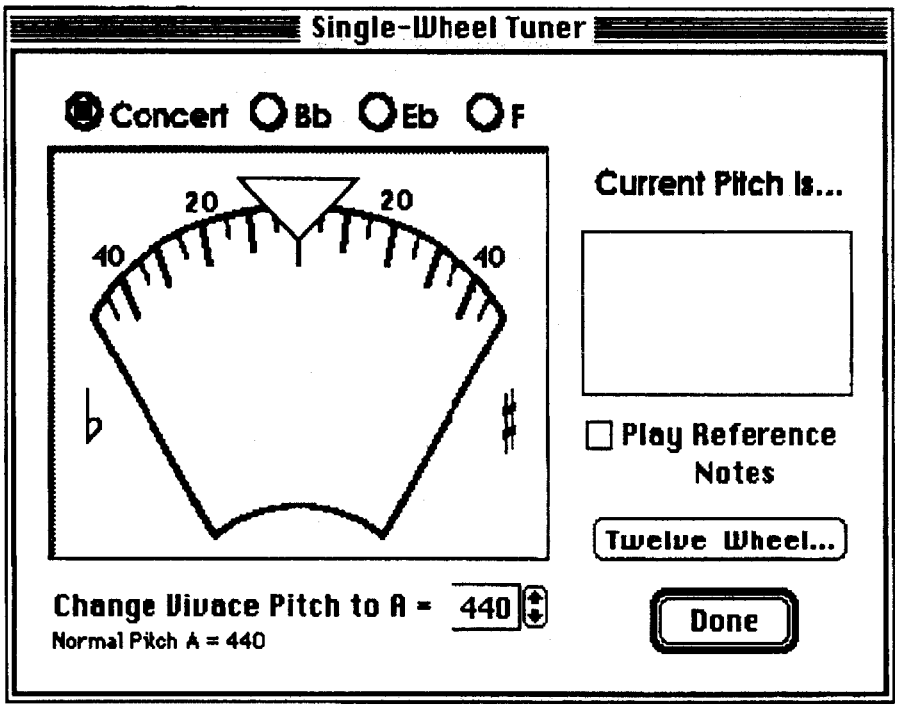
FIG. 44 is a screen display of a single-wheel tune to accompanist window according to the present invention.
Figure 45:
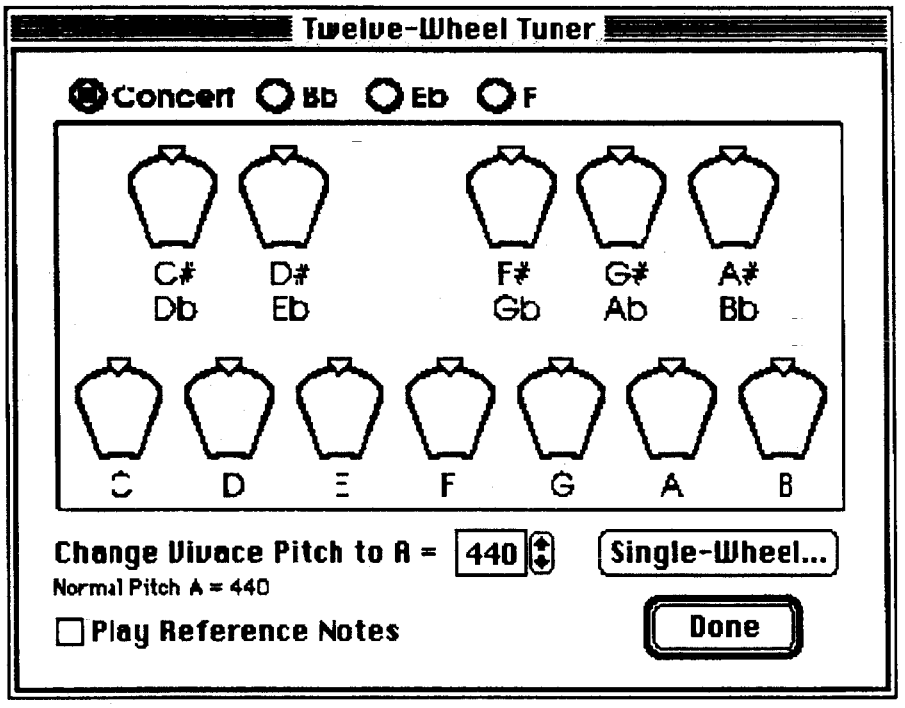
FIG. 45 s a screen display of a twelve-wheel tune to accompanist window according to the present invention.

FIG. 44 and FIG. 45 show a preferred single wheel tune window and twelve-wheel tune window as displayed to the user. This feature allows a soloist to play a note and have the system provide a reference pitch to which the soloist may rehearse or tune. The system indicates the degree the soloist is in tune with a virtual needle mechanism. In addition, the closest corresponding pitch being played by the soloist is automatically displayed. Both modes of a pitch are displayed as appropriate. (e.g. D#/Eb, G#/Ab, etc.) The system preferably implements the reference pitch as a simple MIDI event repeat by first converting a note played by the soloist into a sound related signal reflecting the performance pitch. The performance pitch is then evaluated to determine the closest corresponding pitch in an equally tempered musical scale, and playing the closest corresponding pitch as the reference pitch to the soloist during the soloist performance. Any number of notes may be played by the soloist. All notes played by the soloist will be echoed back by the system when this feature is enabled.

Figure 46:
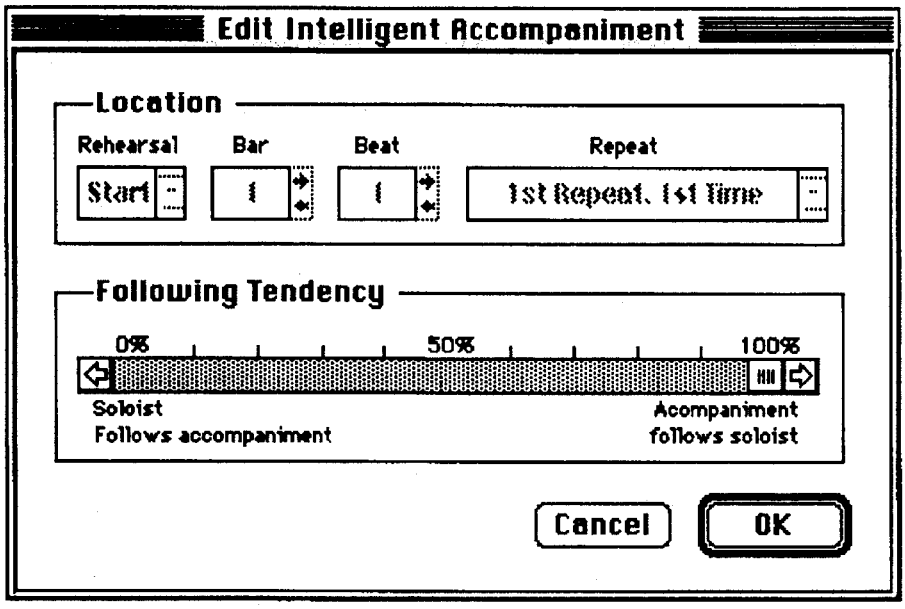
FIG. 46 is a screen display of an edit intelligent accompaniment window according to the present invention.
Figure 47:
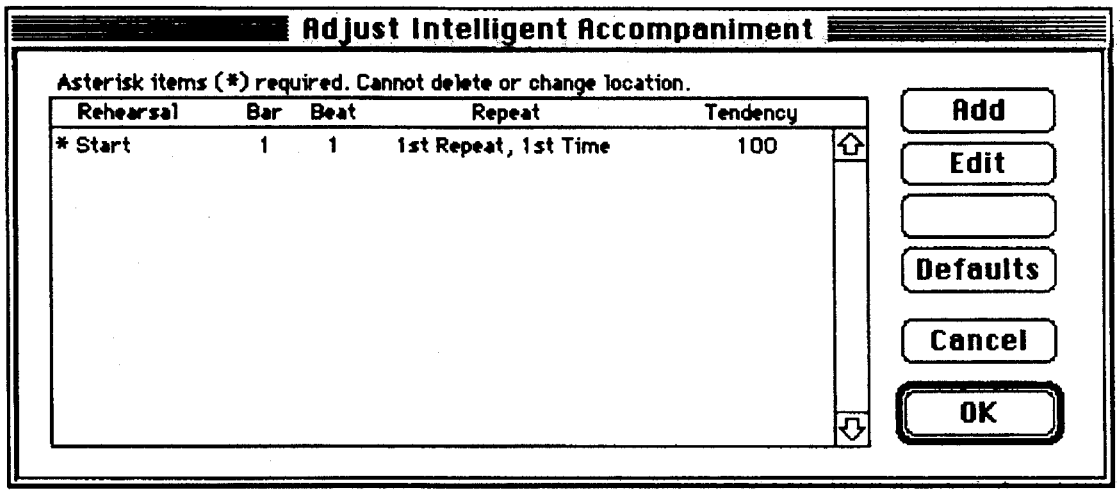
FIG. 47 s a screen display of an adjust intelligent accompaniment window according to the present invention.

FIG. 46 and FIG. 47 show a preferred edit IA window and an adjust IA window as displayed to the user. This feature allows a soloist to change a percent following value to control how closely the system will follow changes in the soloist performance tempo. The percent following value is preferably a proportional control of the difference between the performance score tempo map and the soloist performance tempo. The greater the percent following value, the more closely the IA will follow the soloist's changes in tempo.

For example, if the percent following value is 50%, the tempo map is at 120 beats per minute (bpm), and the soloist plays at 130 bpm, the difference between the tempo map and soloist performance of 10 bpm is multiplied by 50%, giving a value of 5 bpm. This amount is added to the accompaniment tempo at the next note, resulting in a new accompaniment tempo value of 125 bpm. If the soloist continues to play at 130 bpm, the accompaniment tempo adjustment process is repeated until the accompaniment tempo equals that of the soloist, which in this case would take four notes. If the percent following value had been set at 100%, the accompaniment would have gone from 120 bpm to 130 bpm in just one note.

Figure 48:
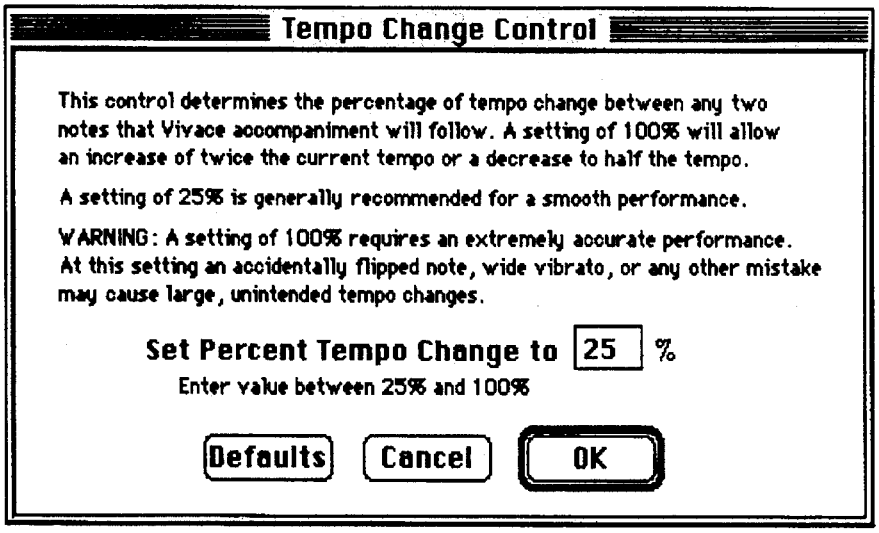
FIG. 48 is a screen display of a tempo change control window according to the present invention.

FIG. 48 illustrates a preferred tempo change control window as displayed to the user. This feature allows a soloist to eliminate unwanted or unintended events from being considered by the system when calculating a tempo change. In addition, there may be intended musical events such as grace notes or trills which should also be ignored. The percent change value is preferably a proportional filter of the percent difference between the current soloist tempo and the tempo of an incoming soloist note. If the difference exceeds the percent change value, the incoming soloist note is ignored when calculating the accompaniment tempo or position.

For example, if the percent change value is 25%, the current tempo is at 120 bpm, and an incoming soloist note is at 156 bpm, the difference in tempo is 156–120=36 bpm, or 30%. Because this 30% difference is greater than the 25% percent change value, the incoming soloist event is not used to modify the accompaniment tempo or position.

When calculating the accompaniment tempo, the weighting of the tempo map preferably changes when the difference in tempo between the tempo map and the soloist performance exceeds a certain threshold. By experimental observation, the threshold has been found to be musically suitable at five percent, although it will be recognized that other threshold percentages may be used without loss of generality. If the soloist goes above or below five percent of the tempo reference, an accompaniment expectation value (or rate) is increased or decreased as to what the soloist will do. The expectation value is used when making any subsequent accompaniment tempo changes.

For example, if the tempo map is at 120 bpm and the soloist plays ten percent faster at 132 bpm, the soloist expectation value will increase from 120 bpm to 132 bpm. If a mark within the tempo map indicates a ritard, the accompaniment will expect the soloist to also retard, but at a rate ten percent above what would otherwise be expected by the tempo map if the soloist had not previously been playing faster. The accompaniment will compensate for any discrepancy in the rate of ritard by the soloist from what is expected. If a tempo reset is encountered within the tempo map, the tempo expectation is reset to the previous soloist expectation value. It is important to note that the expectation value is rate of change which is used with other factors such as the percent following value and the percent change value when determining any given accompaniment tempo.

A potential problem occurs when there is a period within the music piece, such as a rest, where the accompaniment does not play. If the rest extends over several measures or even longer, it is difficult for the accompaniment to come back in and rejoin the soloist at the correct time unless the accompaniment closely follows the soloist performance during the rest period. Therefore, the preferred embodiment of the present invention automatically adjusts the percent following value to 90–100% and the percent change value to 100% when the accompaniment rests for more than two beats. This produces musically acceptable results, since any roughness within the accompaniment following is not detectable by the soloist because the accompaniment is not playing. It will be recognized that percent following values less than 90–100% and rest periods other than two beats may be substituted without loss of generality.

Markers are inserted into the repertoire file at rest places to indicate that the IA parameters should be opened to 100% following, 100% tempo change. This window of values overrides previous settings, but following typically must be enabled for them to have effect. The Markers are designated as OW (Open Window) at the beginning of the section, and CW (Close Window) at the end. They are typically applied to sections of a specified length where the accompaniment is not playing but the soloist is.

An Instrumentation dialog box is active in jazz mode, where selecting and unselecting instruments preferably causes them to immediately start and stop playing. In classical solo mode, selecting an instrument preferably causes it to be active and will play according to the music score.

Figure 50:
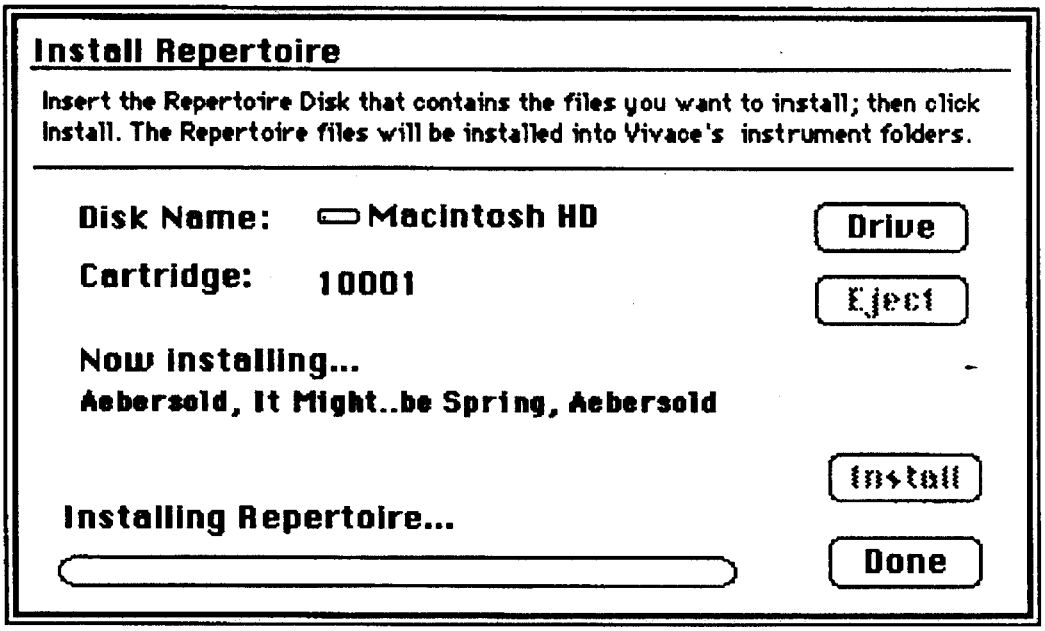
FIG. 50 is a screen display of a first repertoire install window according to the present invention.
Figure 51:
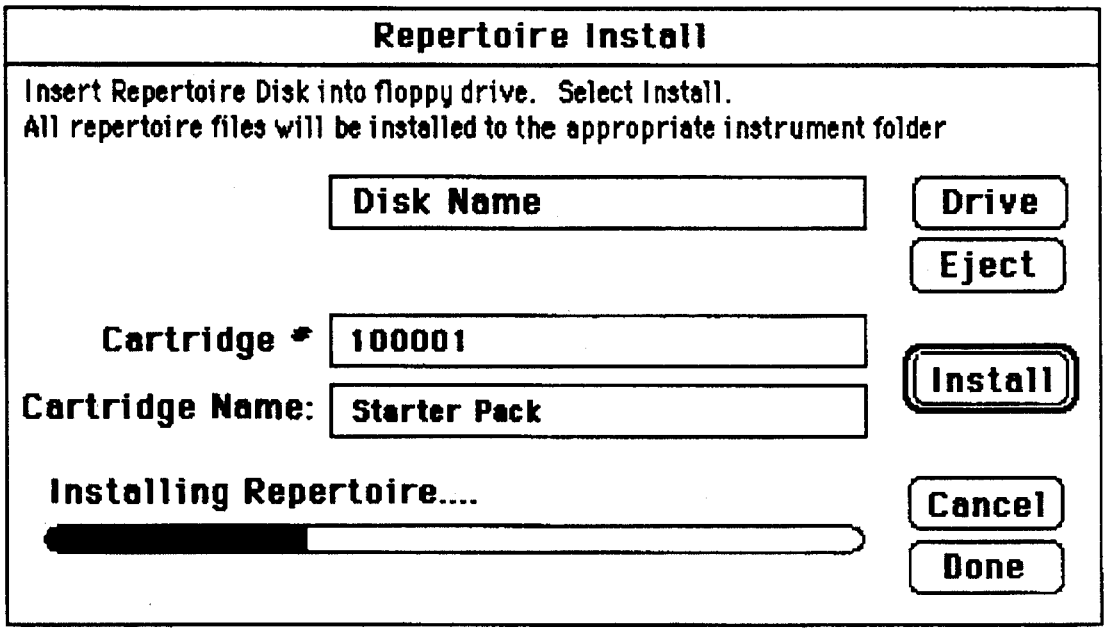
FIG. 51 is a screen display of a second repertoire install window according to the present invention.

FIG. 50 and FIG. 51 show preferred repertoire install windows as displayed to the user. This feature allows a user to install a repertoire file into the file structure that was provided for repertoire when the application was installed. The user preferably selects the virtual install button and the system detects the installation disk. The installer preferably does not prompt for multiple disks. For example, if the repertoire is on three disks, each repertoire disk may be inserted individually and installed separately from the others.

New Data Structures and File Formats

The data format for music tracks is given below. This is information is used for the performance score.

```
#pragma segment MAWriteFile
void VivDocument::Write(HFILE hfile, boolean withOptions)
{
    MMCKINFO ckRiff = { kRiffChunk, 4L, kVivaType, 0,
MMIO_WORDALIGN };
    MMCKINFO ckTemp = { 0, 0, 0, 0,
    MMIO_WORDALIGN };
    HMMIO mmio = new MMIO(hFile);
    mmio->CreateChunk(&ckRiff, MMIO_CREATERIFF);
    ckTemp.ckid = kListChunk;
    ckTemp.fccType = kInfoType;
    mmio->CreateChunk(&ckTemp, MMIO_CREATELIST);
    this->WriteInfoList(mmio, &ckTemp);
    mmio->Ascend(&ckTemp, 0);
    ckTemp.ckid = kSKUChunk;
    mmio->CreateChunk(&ckTemp, 0);
    this->WriteSKU(mmio);
    this->WriteSKUKeys(mmio);
    mmio->Ascend(&ckTemp, 0);
    ckTemp.ckid = kInstTypeChunk;
    mmio->CreateChunk(&ckTemp, 0);
    this->WriteInstType(mmio);
    mmio->Ascend(&ckTemp, 0);
    ckTemp.ckid = kScoreDefChunk;
    mmio->CreateChunk(&ckTemp, 0);
    this->WriteScoreDef(mmio);
    mmio->Ascend(&ckTemp, 0);
    ckTemp.ckid = kRepeatsListChunk;
    mmio->CreateChunk(&ckTemp, 0);
    mmio->BufferWrite(&ckTemp);
    this->WriteRepeatsList(mmio);
    mmio->Ascend(&ckTemp, 0);
    ckTemp.ckid = kMarksListChunk;
    mmio->CreateChunk(&ckTemp, 0);
    mmio->BufferWrite(&ckTemp);
    this->WriteMarksList(mmio);
    mmio->Ascend(&ckTemp, 0);
    ckTemp.ckid = kListChunk;
    ckTemp.fccType = kTrackType;
    mmio->CreateChunk(&ckTemp, MMIO_CREATELIST);
    this->WriteTrackList(mmio, &ckTemp);
    mmio->Ascend(&ckTemp, 0);
    ckTemp.ckid = kScoreDataChunk;
    mmio->CreateChunk(&ckTemp, 0);
    mmio->BufferWrite(&ckTemp);
    this->WriteScoreData(mmio);
    mmio->Ascend(&ckTemp, 0);
    if (withOptions) this->WriteOptions(mmio, gEmptyString,
&ckRiff);
    mmio->Ascend(&ckRiff, 0);
    delete mmio;
}
```

The data format for an options file is given below. This is information is used to store soloist preferences.

```
#pragma segment MAWriteFile
void VivDocument::WriteOptions(HMMIO mmio, CStr255&
optName, MMCKINFO*)
{
    MMCKINFO ckOptions = { kOptionsChunk, 0, 0, 0,
MMIO_WORDALIGN };
    MMCKINFO ckTemp = { 0, 0, 0, 0,
    MMIO_WORDALIGN };
    if (mmio->CreateChunk(&ckOptions, 0) == 0)
    {
        if (optName.Length( ))
        {
            ckTemp.ckid = kNameChunk;
            mmio->CreateChunk(&ckTemp, 0);
                mmio->Write(optName.fStr,
optName.Length( )+1);
                mmio->Ascend(&ckTemp, 0);
        }
        VivTrack* aTrack = this->GetUserEventTrack( );
        if (aTrack)
```

-continued

```
        {
            ckTemp.ckid = kUserEvtChunk;
            mmio->CreateChunk(&ckTemp, 0);
                mmio->BufferWrite(&ckTemp);
                aTrack->Write(mmio);
                mmio->Ascend(&ckTemp, 0);
        }
        aTrack = this->GetCutsTrack( );
        if (aTrack)
        {
            ckTemp.ckid = kCutsChunk;
            mmio->CreateChunk(&ckTemp, 0);
                aTrack->Write(mmio);
                mmio->Ascend(&ckTemp, 0);
        }
        ckTemp.ckid = kOptsChunk;
        mmio->CreateChunk(&ckTemp, 0);
            this->WriteOpts(mmio);
            mmio->Ascend(&ckTemp, 0);
        mmio->Ascend(&ckOptions, 0);
    }
}
```

The data format for an information list is given below. This is information is used to store soloist preferences.

```
#pragma segment MAWriteFile
void VivDocument::WriteInfoList(HMMIO mmio,
MMCKINFO*)
{
    MMCKINFO ckTemp = { 0, 0, 0, 0,
    MMIO_WORDALIGN };
    char*       dataPtr;
    char temp[31];
    ckTemp.ckid = kNameChunk;
    mmio->CreateChunk(&ckTemp, 0);
    mmio->Write((char*)Header.Description,
Header.Description.Length( )+1);
    mmio->Ascend(&ckTemp, 0);
    ckTemp.ckid = kSoftwareChunk;
    mmio->CreateChunk(&ckTemp, 0);
    sprintf(temp, "Vivace %d.%d[0]",
HIBYTE(Header.SoftwareVersion),
LOBYTE(Header.SoftwareVersion));
    mmio->Write(temp, strlen(temp)+1);
    mmio->Ascend(&ckTemp, 0);
    ckTemp.ckid = kPublisherChunk;
    mmio->CreateChunk(&ckTemp, 0);
    mmio->Write((char*)Header.Publisher,
Header.Publisher.Length( )+1);
    mmio->Ascend(&ckTemp, 0);
    ckTemp.ckid = kCopyrightChunk;
    mmio->CreateChunk(&ckTemp, 0);
    mmio->Write((char*)Header.Copyright,
Header.Copyright.Length ( )+1);
    mmio->Ascend(&ckTemp, 0);
    ckTemp.ckid = kCreationChunk;
    mmio->CreateChunk(&ckTemp, 0);
    mmio->Write((char*)CreationDate,
CreationDate.Length( )+1);
    mmio->Ascend(&ckTemp, 0);
    ckTemp.ckid = kCreatorChunk;
    mmio->CreateChunk(&ckTemp, 0);
    mmio->Write((char*)Creator, Creator.Length( )+1);
    mmio->Ascend(&ckTemp, 0);
    ckTemp.ckid = kVersionChunk;
    mmio->CreateChunk(&ckTemp, 0);
    mmio->Write((char*)Header.RepertoireVersion,
Header.RepertoireVersion.Length( )+1);
    mmio->Ascend(&ckTemp, 0);
    ckTemp.ckid = kCommentChunk;
    mmio->CreateChunk(&ckTemp, 0);
    mmio->Write((char*)Comment, Comment.Length( )+1);
    mmio->Ascend(&ckTemp, 0);
    if (hComposerBio)
    {
        ckTemp.ckid = kComposerBioChunk;
        mmio->CreateChunk(&ckTemp, 0);
        dataPtr = (char*)HandleLock(hComposerBio);
        mmio->Write(dataPtr, ComposerBioSize);
        HandleUnlock(hComposerBio);
        mmio->Ascend(&ckTemp, 0);
    }
    if (hComposition)
    {
        ckTemp.ckid = kCompositionChunk;
        mmio->CreateChunk(&ckTemp, 0);
        dataPtr = (char*)HandleLock(hComposition);
        mmio->Write(dataPtr, CompositionSize);
        HandleUnlock(hComposition);
        mmio->Ascend(&ckTemp, 0);
    }
    if (hPerformance)
    {
        ckTemp.ckid = kPerformanceChunk;
        mmio->CreateChunk(&ckTemp, 0);
        dataPtr = (char*)HandleLock(hPerformance);
        mmio->Write(dataPtr, PerformanceSize);
        HandleUnlock(hPerformance);
        mmio->Ascend(&ckTemp, 0);
    }
}
```

The data format for a track list is given below. This is information is used to store number and types of performance tracks.

```
#pragma segment MAWriteFile
void VivDocument::WriteTrackList(HMMIO mmio,
MMCKINFO*)
{
    MMCKINFO ckTemp = {0, 0, 0, 0,
    MMIO_WORDALIGN };
    u8bit instrNum = 0;
    for (u8bit i=0; i<MAX_VIVTRACKS; i++)
    {
        VivTrack* aTrack = theTracks[i];
        if (aTrack)
        {
            switch (aTrack->TrackType)
            {
                case PRESETS_TRACK:                ckTemp.
                                                   ckid =
kPresetChunk;           break;
                case MEASURE_TRACK:                ckTemp.
                                                   ckid =
kMeasureChunk;          break;
                case TEMPO_TRACK:                  ckTemp.
                                                   ckid =
kTempoChunk;            break;
                case SCOREMARKS_TRACK:             ckTemp.
                                                   ckid =
kScoreMarksChunk;       break;
                case SOLO_TRACK:                   ckTemp.
                                                   ckid =
kSoloChunk;             break;
                case DEF_USEREVT_TRACK:            ckTemp.
                                                   ckid =
kDefUserEvtChunk;       break;
                default:
                {
                    if ((aTrack->TrackType >=
INSTRUMENT_TRACK) &&
                        (aTrack->TrackType<
INSTRUMENT_TRACK+16))
                    {
                        ckTemp.ckid = kInstChunk;
                    }
                    else ckTemp.ckid = 0;
                    break;
                }
            }
```

-continued

```
            if (ckTemp.ckid && aTrack->NumberOfEvents( ))
            {
                mmio->CreateChunk(&ckTemp, 0);
                mmio->BufferWrite(&ckTemp);
                aTrack->Write(mmio);
                mmio->Ascend(&ckTemp, 0);
            }
        }
    }
}
```

The data format for user options is given below.

```
#pragma segment MAWriteFile
void VivDocument::WriteOpts(HMMIO mmio)
{
    Options.Instrumentation = 0;
    for (u8bit i=0; i < 16; i++)
    {
        VivTrack* aTrack = theTracks
        [i+INSTRUMENT_TRACK];
        if (aTrack && aTrack->Active)
Options.Instrumentation | = (1 << i);
    }
    mmio->Write8bit(Options.UseOptions);
    mmio->Write8bit(Options.CountoffOption);
    mmio->Write8bit(Options.PauseBars);
    mmio->Write16bit(Options.SetTempo);
    mmio->Write8bit(Options.Transpose);
    mmio->Write32bit(Options.UseRepeatsMask);
    mmio->Write32bit(Options.ReverbSettings);
    mmio->Write16bit(Options.Instrumentation);
    mmio->Write8bit(Options.Feel);
    mmio->Write32bit(Options.PracticeFrom);
    mmio->Write32bit(Options.PracticeTo);
    mmio->Write8bit(Options.PracticeCountoffOption);
    mmio->Write8bit(Options.TempoChangeControl);
```

The present invention is to be limited only in accordance with the scope of the appended claims, since others skilled in the art may devise other embodiments still within the limits of the claims.

What is claimed is:

1. A method for creating a repertoire data file for use with an automated accompaniment system having a sound synthesizer with one or more preset sound types, the method comprising the steps of:

(a) creating a music sequence data segment containing information on pitch and duration of notes in a musical performance score;

(b) marking the music sequence data segment to match a musical performance score using a musical instrument digital interface (MIDI) marker message;

(c) creating an information data segment containing biographical and compositional information for the musical performance score; and (d) combining the music sequence data segment and information data segment into the single repertoire data file.

2. The method of claim 1 wherein the step of marking the music sequence data segment includes marking rehearsal marks, tempo section, time signature, instrumentation, intelligent accompaniment, and other options.

3. A computerized method for interpreting instrument soloist requests and instrumental soloist performance in order to control a digitized musical accompaniment performance, the soloist performance including sound events having a pitch, time duration, and event time and type, the method comprising the steps of:

(a) converting at least a portion of the soloist performance into a sequence of sound related signals;

(b) comparing the pitch, duration and event type of individual events of the soloist performance sound related signals to a desired sequence of a performance score to determine if a match exists between the soloist performance and the performance score;

(c) providing accompaniment for the soloist performance if a match exists between the soloist performance sound related signals and the performance score;

(d) selecting a percentage following of the accompaniment for the soloist performance by a value, the value of the percentage having a range between 0 and 100 percent; and (e) effecting a match between the soloist performance and the performance score if there is a departure from the performance score by the soloist performance.

4. The method of claim 3 further comprising the step of filtering individual events of the soloist performance by a percentage change value, the percentage change value having a range between 0 and 100 percent, such that unwanted and unintended individual events of the soloist performance are removed.

5. The method of claim 4 further comprising the step of dynamically increasing the percentage change value to a value of 90 to 100 percent during an accompaniment rest period in the performance score, such that the accompaniment closely follows the soloist performance to accurately join the soloist performance when the accompaniment rest period ends.

6. The method of claim 5 wherein the accompaniment rest period in the performance score comprises at least two beats.

7. The method of claim 3 further comprising the step of increasing and decreasing a time delay between individual events of the soloist performance and a corresponding accompaniment for the soloist performance by a fine adjustment value, such that the accompaniment for the soloist performance is corrected for rushing and dragging.

8. The method of claim 3 further comprising the step of dynamically decreasing the value of the percentage following when a change occurs in a performance score tempo map exceeding a threshold value.

9. The method of claim 3 further comprising the step of resuming a paused musical accompaniment performance upon detection of an individual soloist event.

10. The method of claim 3 further comprising the step of terminating a held accompaniment note upon detection of an individual soloist event.

11. The method of claim 3 further comprising the step of terminating a held accompaniment note upon detection of a footswitch event.

12. The method of claim 3 further comprising the step of resuming the accompaniment upon detection of a footswitch event.

13. The method of claim 3 further comprising the step of terminating a held accompaniment note upon detection of a note off event.

14. The method of claim 3 further comprising the step of resuming the accompaniment upon detection of a note off event.

15. A computerized method for providing a reference pitch to an instrumental soloist comprising the steps of:

(a) converting a note of a performance by the soloist into a sound related signal reflecting performance pitch;

(b) evaluating the performance pitch of the sound related signal and determining a closest corresponding pitch in an equally tempered musical scale; and (c) providing the closest corresponding pitch as the reference pitch to the soloist during the soloist performance.

16. A method for creating a preferences data file for use with an automated accompaniment system having a sound synthesizer with one or more preset sound types, the method comprising the steps of:

(a) creating a performance file data segment containing information on a musical performance score file;

(b) creating a soloist data segment containing an identifier for a soloist;

(c) creating an information data segment containing preferred soloist performance settings;

(d) matching the information data segment to the soloist data segment; and (e) combining the performance file data segment, soloist data segment, and information data segment into the preferences data file.

17. The method of claim 16 wherein the soloist performance settings include practice loop, countoff settings, click status, cuts, reverb, transposition, tempo markings, intelligent accompaniment (IA) markings, instrumentation, repeats, and fine adjustments.

* * * * *

UNITED STATES PATENT AND TRADEMARK OFFICE
CERTIFICATE OF CORRECTION

PATENT NO. : 5,455,378

DATED : October 3, 1995

INVENTOR(S) : Paulson et al.

It is certified that error appears in the above-identified patent and that said Letters Patent is hereby corrected as shown below:

Col. 8, line 63 "At" should read --Δt--

Col. 22, line 44 "RM/" should read --RM/_____--

Col. 23, line 54 "40-1:R,2,12" should read --40-1:R3,2,12--

Col. 24, line 18 "101-1:E,53" should read --101-1:E4,53--

Col. 30, line 4 "hfile" should read --hFile--

Col. 31, line 39 "d[0]" should read --d\0--

Col. 32, line 63 "=klnstChunk" should read -- =kInstChunk--

Signed and Sealed this

Nineteenth Day of November, 1996

*Attest:*

*Attesting Officer*

BRUCE LEHMAN

*Commissioner of Patents and Trademarks*